US009387533B1

(12) United States Patent
Heneveld et al.

(10) Patent No.: US 9,387,533 B1
(45) Date of Patent: Jul. 12, 2016

(54) SYSTEMS, DEVICES, AND METHODS INVOLVING PRECISION COMPONENT CASTINGS

(71) Applicant: Mikro Systems, Inc., Charlottesville, VA (US)

(72) Inventors: Benjamin Heneveld, Newmarket, NH (US); John R. Paulus, Afton, VA (US); Jon T. Moore, Charlottesville, VA (US)

(73) Assignee: Mikro Systems, Inc., Charlottesville, VA (US)

( * ) Notice: Subject to any disclaimer, the term of this patent is extended or adjusted under 35 U.S.C. 154(b) by 0 days.

(21) Appl. No.: 14/868,514

(22) Filed: Sep. 29, 2015

Related U.S. Application Data

(60) Provisional application No. 62/056,715, filed on Sep. 29, 2014.

(51) Int. Cl.

| | |
|---|---|
| ***B22C 9/02*** | (2006.01) |
| ***B22C 9/10*** | (2006.01) |
| ***B22D 25/02*** | (2006.01) |
| ***B22D 29/00*** | (2006.01) |
| ***B22C 9/04*** | (2006.01) |

(52) U.S. Cl.
CPC . *B22D 25/02* (2013.01); *B22C 9/04* (2013.01); *B22C 9/10* (2013.01); *B22D 29/001* (2013.01)

(58) Field of Classification Search
CPC ..... B22C 7/02; B22C 7/06; B22C 9/04; B22C 9/10; B22C 9/103; B22C 9/24
USPC ..... 164/23, 24, 28, 34–36, 137, 369, 164/516–529
See application file for complete search history.

(56) References Cited

U.S. PATENT DOCUMENTS

| | | | | |
|---|---|---|---|---|
| 4,421,153 | A * | 12/1983 | Wilkinson | B22C 9/04 164/34 |
| 5,641,014 | A * | 6/1997 | O'Connor | B22C 9/04 164/361 |
| 6,626,230 | B1 * | 9/2003 | Woodrum | B22C 1/22 164/137 |
| 7,141,812 | B2 | 11/2006 | Appleby | |
| 7,410,606 | B2 | 8/2008 | Appleby | |
| 7,411,204 | B2 | 8/2008 | Appleby | |
| 7,438,527 | B2 | 10/2008 | Albert | |
| 7,448,433 | B2 * | 11/2008 | Ortiz | B22C 7/00 164/35 |
| 7,893,413 | B1 | 2/2011 | Appleby | |
| 8,813,824 | B2 | 8/2014 | Appleby | |
| 9,057,277 | B2 | 6/2015 | Appleby | |
| 2011/0132562 | A1 * | 6/2011 | Merrill | B22C 9/02 164/9 |
| 2011/0189440 | A1 | 8/2011 | Appleby | |

FOREIGN PATENT DOCUMENTS

WO WO2010036801 4/2010

* cited by examiner

*Primary Examiner* — Kevin E Yoon
(74) *Attorney, Agent, or Firm* — Michael Haynes PLC; Michael N. Haynes

(57) ABSTRACT

Certain exemplary embodiments can provide a system, machine, device, manufacture, and/or composition of matter configured for and/or resulting from, and/or a method for, activities that can comprise and/or relate to, investment casting a product in a mold, the product comprising at least one wall, the mold comprising a core, an inner primary shell, and an outer secondary shell.

17 Claims, 18 Drawing Sheets

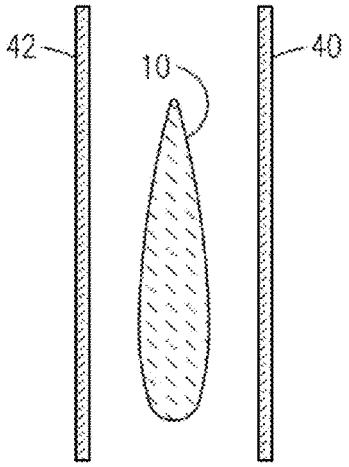
*FIG. 2C*
PRIOR ART
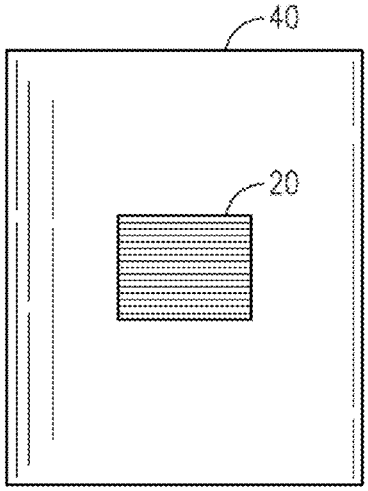
*FIG. 2D1*
PRIOR ART
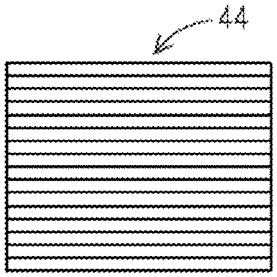
*FIG. 2D2*
PRIOR ART
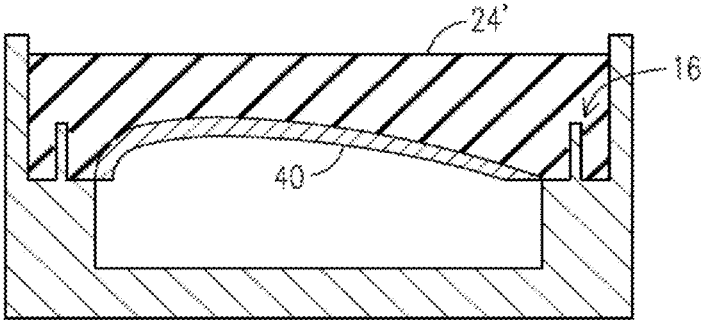
*FIG. 2E1*
PRIOR ART

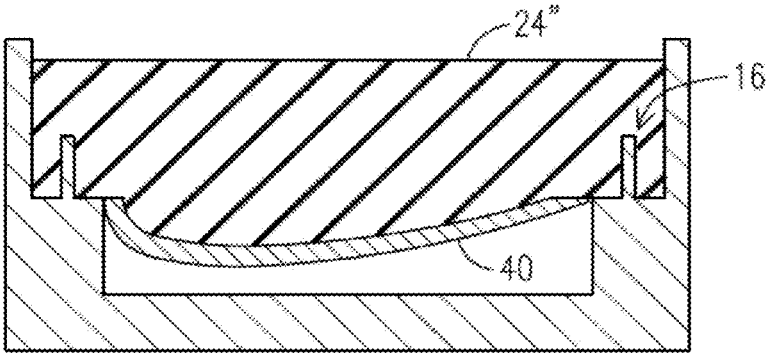
FIG. 2E2
PRIOR ART
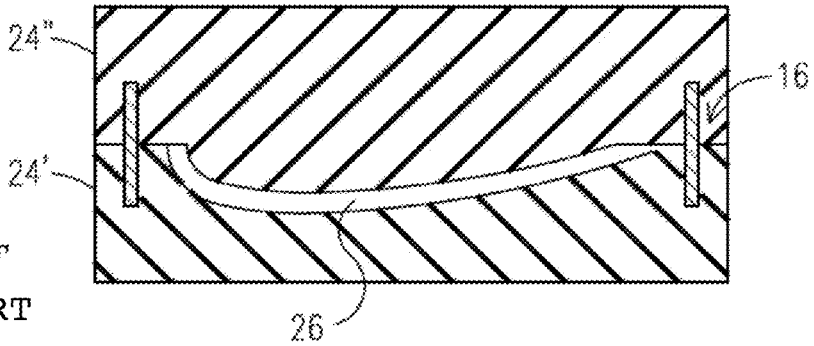
FIG. 2F
PRIOR ART
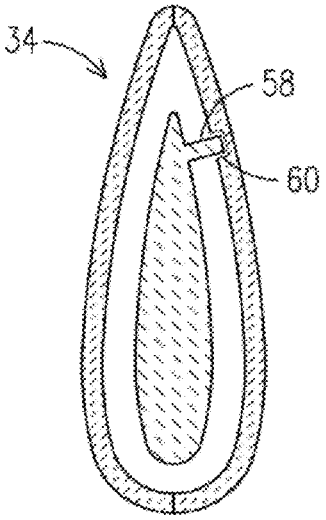
FIG. 2G
PRIOR ART
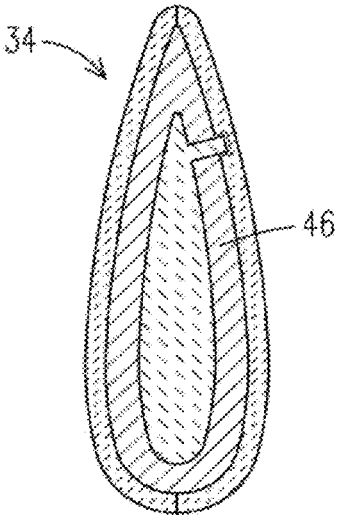
FIG. 2H
PRIOR ART

SYSTEMS, DEVICES, AND METHODS INVOLVING PRECISION COMPONENT CASTINGS

CROSS-REFERENCES TO RELATED APPLICATIONS

This application claims priority to, and incorporates by reference herein in its entirety, U.S. Provisional Patent Application 62/056,715, filed 29 Sep. 2014.

BRIEF DESCRIPTION OF THE DRAWINGS

A wide variety of potential, feasible, and/or useful embodiments will be more readily understood through the herein-provided, non-limiting, non-exhaustive description of certain exemplary embodiments, with reference to the accompanying exemplary drawings in which:

FIGS. 2A-2I illustrate exemplary activities of an exemplary direct shell precision casting process.

DESCRIPTION

Figure 1A:
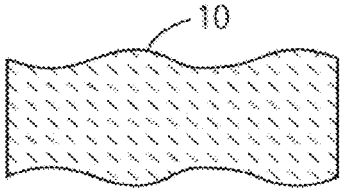
FIG. 1A PRIOR ART
FIGS. 1A-F illustrate an exemplary activities for manufacturing an exemplary ceramic core for an exemplary investment casting process.

Investment casting can be used in numerous industries, such as in the aerospace and/or power industries to produce turbine components such as blades having complex airfoil shapes and/or complex internal cooling passage geometries.

The production of a gas turbine blade using an investment casting process (e.g., a lost-wax casting process) can involve producing a ceramic casting vessel having an outer ceramic shell, which can correspond to the airfoil shape of the blade, and one or more ceramic cores positioned within the outer ceramic shell, those cores corresponding to interior cooling passages to be formed within the blade. Molten high temperature alloy can be introduced into the ceramic casting vessel using high-pressure injection and then can be allowed to cool and harden. The outer ceramic shell and ceramic core(s) then can be removed by mechanical and/or chemical means to reveal the cast blade, which can have an external airfoil shape that corresponds to the internal shape of the shell and/or can have hollow interior airfoil cooling passages in the shape of the exterior shape of the ceramic core(s).

The ceramic core(s) for this process can be manufactured by first precision machining the desired core shape into mating core mold halves formed of high strength hardened machine steel, then joining the mold halves to define an injection volume corresponding to the desired core shape, and vacuum injecting a ceramic molding material into the injection volume. The molding material can be a mixture of ceramic powder and binder material. Once the ceramic molding material has hardened to a green state, the mold halves can be separated to release the green state ceramic core. The fragile green state core then can be thermally processed to remove the binder and/or to sinter the ceramic powder together to develop the strength necessary for the core to survive further handling and subsequent use during the investment casting process.

The complete ceramic casting vessel can be formed by positioning the ceramic core within the two joined halves of another precision machined hardened steel mold (referred to as the wax mold or wax pattern tooling), which can define an injection volume that corresponds to the desired external or airfoil shape of the blade, and then vacuum injecting melted wax into the wax mold around the ceramic core. Once the wax has hardened, the wax mold halves can be separated and removed to reveal the wax pattern, which includes the ceramic core encased inside the wax, with the wax pattern outer surface now corresponding to the desired airfoil shape. The outer surface of the wax pattern then can be coated with a ceramic mold material, such as by a dipping process, to form the ceramic shell around the wax pattern. Upon hardening of the shell and removal of the wax by melting and/or other means, the completed ceramic casting vessel can be available to receive molten metal alloy in the investment casting process, as described above.

The lost-wax investment casting process can be expensive and/or time consuming, with the development of casting molds for a new blade design potentially taking many months and hundreds of thousands of dollars to complete. Furthermore, gas turbine blade design choices can be restricted by process limitations in the production of ceramic cores because of fragility of the cores and/or an inability to achieve acceptable yield rates for cores having fine features and/or large sizes. Likewise, other fundamental limitations might significantly inhibit component designs for the next generation of gas turbine engines. For example, gas turbine firing temperatures continue to be increased in order to improve the efficiency of combustion, which can cause the internal cooling requirements of those engines to become increasingly complex. Thus, as the market demands ever higher efficiency and power output from gas turbine engines, the limitations of certain investment casting processes might become ever more problematic.

Certain exemplary embodiments can utilize a master mold that can be machined from a relatively soft, easily machined, and/or inexpensive material, when compared to the currently used high strength machine steel, such as aluminum and/or mild steels. Two master mold halves can be formed, one corresponding to each of two opposed sides of a desired ceramic core shape. Into each master mold a flexible mold material can be cast to form two cooperating flexible mold halves, which when joined together can define an interior volume corresponding to the desired ceramic core shape. Ceramic mold material then can be cast into the flexible mold and allowed to cure to a green state.

The cost and time to produce the master molds can be minimized by the use of materials that are easily machined. At least a portion of the master mold halves can be designed to receive a precision formed insert. That insert can be formed using a TOMO process, such as described in U.S. Pat. Nos. 7,141,812 and 7,410,606, and 7,411,204, all assigned to Mikro Systems, Inc. of Charlottesville, Va., and the contextually relevant portions of which are incorporated by reference herein in their entirety. This technology is sometimes referred to as TOMO Lithographic Molding Technology (herein referred to as "TOMO"), and it can involve the use of a metallic foil stack lamination mold to produce a flexible derived mold, which in turn can be used to cast a component part. In this manner, portions of the ceramic core that have a relatively low level of detail, such as long smooth channel sections, can be translated into the master mold using inexpensive standard machining processes in the soft alloy mold, while other portions of the ceramic core having a relatively high level of detail, such as micro-sized surface turbulators and/or complex passage shapes, can be translated into the master mold using a TOMO-derived mold insert. For cooling channel designs requiring the use of multiple cores, TOMO-derived mold inserts can be used to define precision cooperating joining geometries in each of the multiple cores so that when the multiple cores are jointly positioned within a ceramic casting vessel, the joining geometries of the respective cores will mechanically interlock such that the multiple cores function as a single core during the subsequent alloy injection process.

Certain exemplary embodiments can utilize a ceramic molding composition, such as that described in International Patent Application PCT/US2009/58220, which is assigned to Mikro Systems, Inc. of Charlottesville, Va. and the contextually relevant portions of which are incorporated by reference herein.

Via certain exemplary embodiments, the ceramic core can be positioned within a wax pattern mold to produce a core/wax pattern by injecting melted wax into the wax pattern mold around the ceramic core. The wax pattern then can be dipped into ceramic slurry to produce a ceramic shell around the wax to define the ceramic casting vessel.

As described herein, any of the components described herein, such as turbine components, can be formed via an investment casting process, such as any investment casting process described herein, and/or any combination of steps from any one or more processes described herein. Moreover, any of the components described herein can be formed, in whole or in part, from or into one or more ceramic compositions of matter and/or one or more crystalline structures and/or structural configurations. For example, the production of an investment cast gas turbine blade or vane can involve producing a ceramic casting vessel having an outer ceramic shell with an inside surface corresponding to the desired outer "airfoil" shape of the blade or vane, and one or more ceramic cores positioned within the outer ceramic shell corresponding to interior cooling passages to be formed within the airfoil. In certain exemplary embodiments, as the ceramic casting vessel and/or one or more of its component parts are formed from one or more ceramic compositions, the ceramic composition of matter can undergo a partial and/or full crystal structure change, such as to cristobalite, e.g., from another distinct crystalline and/or amorphous form of silica (silicon dioxide or SiO2), such as α-quartz, β-quartz, tridymite, coesite, seifertite, faujasite, melanophlogite, keatite, moganite, fibrous silica, stishovite, and/or quartz glass, etc. When the ceramic casting vessel is ready to create a casting, molten metallic alloy can be introduced into the ceramic casting vessel, allowed to cool, and thereby harden. In certain exemplary embodiments, as the metallic alloy casting cools from a molten state into a solid and/or non-molten state, its dimensions can shrink, causing the ceramic shell and/or core to fracture and/or substantially structurally disintegrate. The outer ceramic shell, ceramic core(s), and/or their disintegrated remains then can be removed by mechanical (e.g., shaking, blowing, washing, etc.) and/or chemical means to reveal cast part, e.g., the metallic cast blade or vane having the airfoil-like external shape resembling the interior shape of the ceramic shell and/or hollow interior cooling passages resembling the exterior shape of the ceramic core(s).

Prior to introducing the molten alloy, the ceramic core can be positioned within the two joined halves of a precision-machined hardened steel mold (sometimes referred to as the "wax mold"), which can define an injection volume that corresponds to the desired airfoil shape of the blade. Melted wax can be vacuum injected into the wax mold around the ceramic core. Once the wax has hardened, the wax mold halves can be separated and removed to reveal a "wax pattern", that is, a wax-coated ceramic core, with the outer surface of the wax pattern corresponding to the desired airfoil shape. That outer surface of the wax pattern then can be coated with a ceramic mold material, such as via a repeated dipping process, to form the ceramic shell around the wax pattern. Upon hardening of the shell and removal of the wax by melting, chemical dissolving, or the like, the completed ceramic casting vessel can be available to receive molten metallic alloy in the investment casting process, as described above.

Certain exemplary embodiments can eliminate the use of wax and/or wax pattern tooling. In its place, the ceramic shell can be formed directly using processes similar to those described above for the production of the ceramic core, and/or the ceramic shell and ceramic core can be joined together using cooperating alignment features to form the ceramic casting vessel without the need for any wax pattern.

Figure 1B:
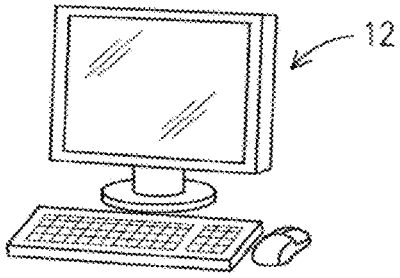
FIG. 1B PRIOR ART
Figure 1C:
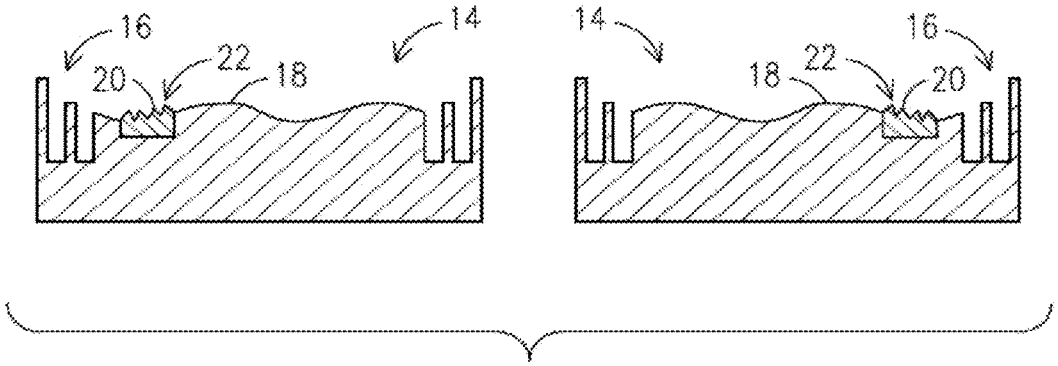
FIG. 1C PRIOR ART
Figure 1D:
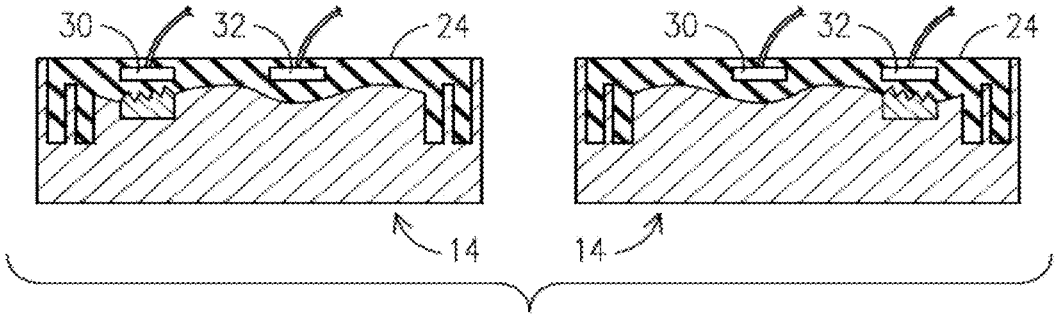
FIG. 1D PRIOR ART
Figure 1E:
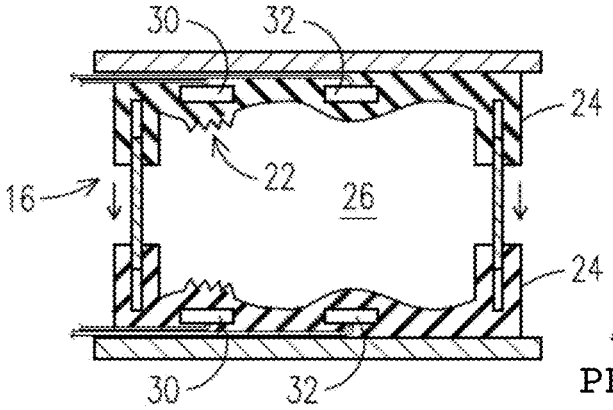
FIG. 1E PRIOR ART
Figure 1F:
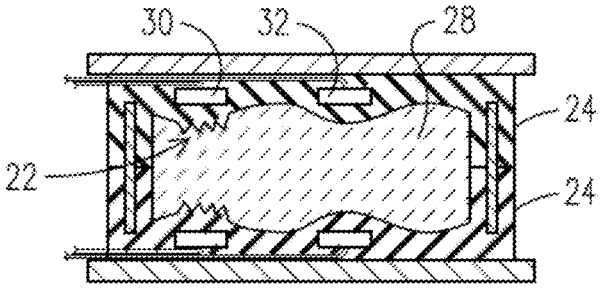
FIG. 1F PRIOR ART

FIGS. 1A-1F illustrate steps of an exemplary waxless casting process for manufacturing an exemplary ceramic core section of a ceramic casting vessel. A digital model of a part having a desired shape, such as the ceramic core 10 shown in FIG. 1A, can be formed using a computerized design system 12, as shown in FIG. 1B. That model can be digitally divided, such as in half, into at least two portions, and/or alignment features may be added to the digital model for subsequent joining of the portions. Master tooling 14 can be produced from the digital models using traditional machining processes and a relatively low cost and easy to machine soft alloy material such as aluminum or soft steel. The master tooling can include the alignment features 16 and/or its surface 18 can reflect the shape of the overall part. Traditional machining processes, such as milling and/or grinding, can produce relatively low precision features with dimensional tolerances, such as on the order of 0.001". If a desired surface feature of the master tool has a relatively high precision requirement, with dimensional tolerances smaller than those achievable with the traditional machining processes, and/or if a desired surface feature of the master tool entails geometry that would be difficult, expensive, or impossible to produce with traditional processes (such as protruding undercuts), a precision formed insert 20 can be installed into the master tool to include the desired surface feature 22. The insert can be formed using a TOMO process, stereo lithography, direct alloy fabrication, and/or other high precision process capable of producing geometry that would be otherwise difficult, expensive, or impossible to produce and/or maintaining dimensional tolerances smaller than those achievable with traditional machining processes such as milling or grinding. The overall tool surface can be a hybrid of the machined surface and the insert surface, as shown in FIG. 1C, where each half of the master tooling contains a precision formed insert that can produce features with dimensional tolerances as low as approximately 0.0002". Flexible molds 24 can be cast from the master tools, as shown in FIG. 1D, and both the low precision and high precision features can be replicated into the flexible molds. The flexible molds can be co-aligned and/or drawn together to define a cavity 26 corresponding to the desired core shape, as shown in FIG. 1E. The cavity can be filled with a slurry of ceramic casting material 28, as shown in FIG. 1F. The flexible molds can be separated once the ceramic casting material has cured to a green state to reveal the ceramic core. The ceramic core can replicate surface features that were first produced in the precision mold inserts, such as a complex surface topography and/or a precision formed joint geometry, for example a dovetail joint, which can be useful for mechanical joining with a corresponding geometry formed in a mating core segment. The ceramic material cast into the flexible mold can have an adequate green body strength to allow such cast features to be removed from the mold even when they contain protruding undercuts and/or non-parallel pull plane features requiring some bending of the flexible mold during removal of the green body ceramic core. Master tool inserts can be useful for rapid prototype testing of alternative design schemes during development testing where the majority of a core remains the same but alternative designs are being tested for one portion of the core. In lieu of manufacturing a completely new master tool for each alternative design, only a new insert need be formed.

Certain exemplary embodiments can use the master tool only for low pressure or vacuum assisted casting of flexible (e.g. rubber) mold material, as described in the above-cited U.S. Pat. Nos. 7,141,812, 7,410,606, and 7,411,204. Thus, low strength, relatively soft, easy to machine soft alloy materials can be used for the master tool, for example, a series 7000 aluminum alloy in one embodiment.

A ceramic casting material, such as described in the above-cited International Patent Application PCT/US2009/58220 can allow the step of FIG. 1F to be performed at relatively low pressure, such as at 10-15 psi. A vibration-assisted injection of the ceramic casting material can be helpful to ensure smooth flow of the material and/or an even distribution of the ceramic particles of the material throughout the mold cavity. The flexibility of the molds can facilitate imparting vibration into the flowing casting material. Vibration of the flexible mold can be effective to displace air entrapped by a protruding surface of the flexible mold with the ceramic casting material slurry. In certain exemplary embodiments, one or more small mechanical vibrators 30 can be embedded into the flexible mold 24 during production of the molds in the step of FIG. 1D. The vibrator(s) can be activated during the FIG. 1F injection of the ceramic casting material in a pattern that can improve the flow of the slurry and/or the distribution of the ceramic particles of the slurry throughout the mold. Other types of active devices 32 can be embedded into the flexible mold, for example any type of sensor (such as a pressure or temperature sensor), a source of heat and/or cooling, and/or a telemetry circuitry, etc.

In certain exemplary embodiments, the epoxy content of the ceramic casting material can range from 28 weight % in a silica-based slurry to as low as 3 weight % (including each and every value and sub-range therebetween). The silicone resin can be a commercially available material such as sold under the names Momentive SR355 or Dow 255. The silicone resin content can range from 3 weight % to as high as 30 weight % (including each and every value and sub-range therebetween). The mix can use 200 mesh silica or even more coarse grains. Solvent content generally goes up as other resins decrease to allow for a castable slurry. The solvent can be used to dissolve the silicone resin and/or blend with the epoxy without a lot of temperature. The Modulus of Rupture (MOR) of the sintered material can be 1500-1800 psi with 10% cristobalite as measured on a 3-point test rig. The sintered material MOR can be tightly correlated to the cristobalite content, with more cristobalite yielding weaker room temperature strength. The green state MOR can depend on the temperature used to cure the epoxy, as it can be a high temperature thermo cure system. The curing temperature can be selected to allow for some thermo-forming, e.g., re-heating the green state material to above a reversion temperature of the epoxy to soften the material, then bending it from its as-cast shape to a different shape desired for subsequent use. The re-heated material can be placed into a setting die within a vacuum bag such that the part is drawn into conformance with the setting die upon drawing a vacuum in the bag. Alignment features can be cast into the core shape for precise alignment with the setting die. The green body casting material can exhibits adequate strength for it to undergo standard machining operations that can be used to add and/or re-shape features to the green body either before and/or after re-shaping in a setting die. Following such thermo-forming or in the absence of it, additional curing can be used to add strength. In certain exemplary embodiments, the Modulus of Rupture achieved was:

MOR cured at 110° C. for 3 hours=4000 psi

MOR cured as above and then at 120° C. for 1 hour=8000 psi.

A range of 5% to 15% (inclusive and including each and every value and sub-range therebetween), such as 6.9%, 8.456%, 9%, 10%, 11.75%, 14%, etc., as-fired cristobalite content can be targeted. This can be altered by the mineralizers present and/or the firing schedule. The initial cristobalite content can be used to create a crystalline seed structure throughout the part to assure that most of the rest of the silica converts to cristobalite in a timely fashion when the core is heated prior to pouring molten alloy into the ceramic mold. The cristobalite content can keep the silica from continuing to sinter into itself as it heats up again.

The material described above typically has a porosity of approximately 23% to approximately 31% (inclusive and including each and every value and sub-range therebetween), such as 23.8%, 24.6%, 25.251%, 25.8%, 27%, 28.4%, 29%, etc. The material described above has not presented a situation where the cast alloy cannot crush the ceramic core as it shrinks and cools, thereby creating alloy crystalline damage that is referred to in the art as "hot tear".

Figure 16A:
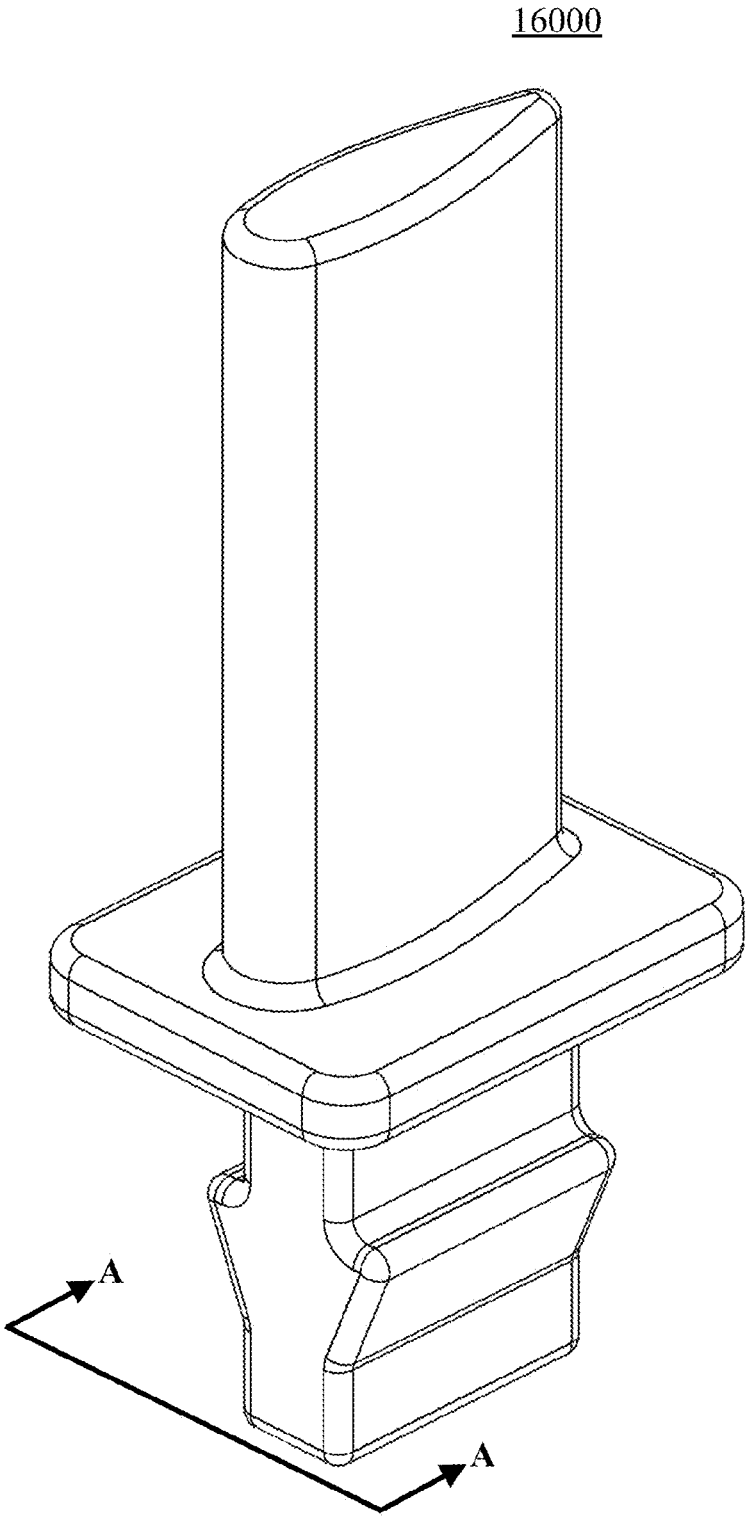
FIGS. 16A and 16B illustrate an exemplary embodiment of a generic cast part.
Figure 16B:
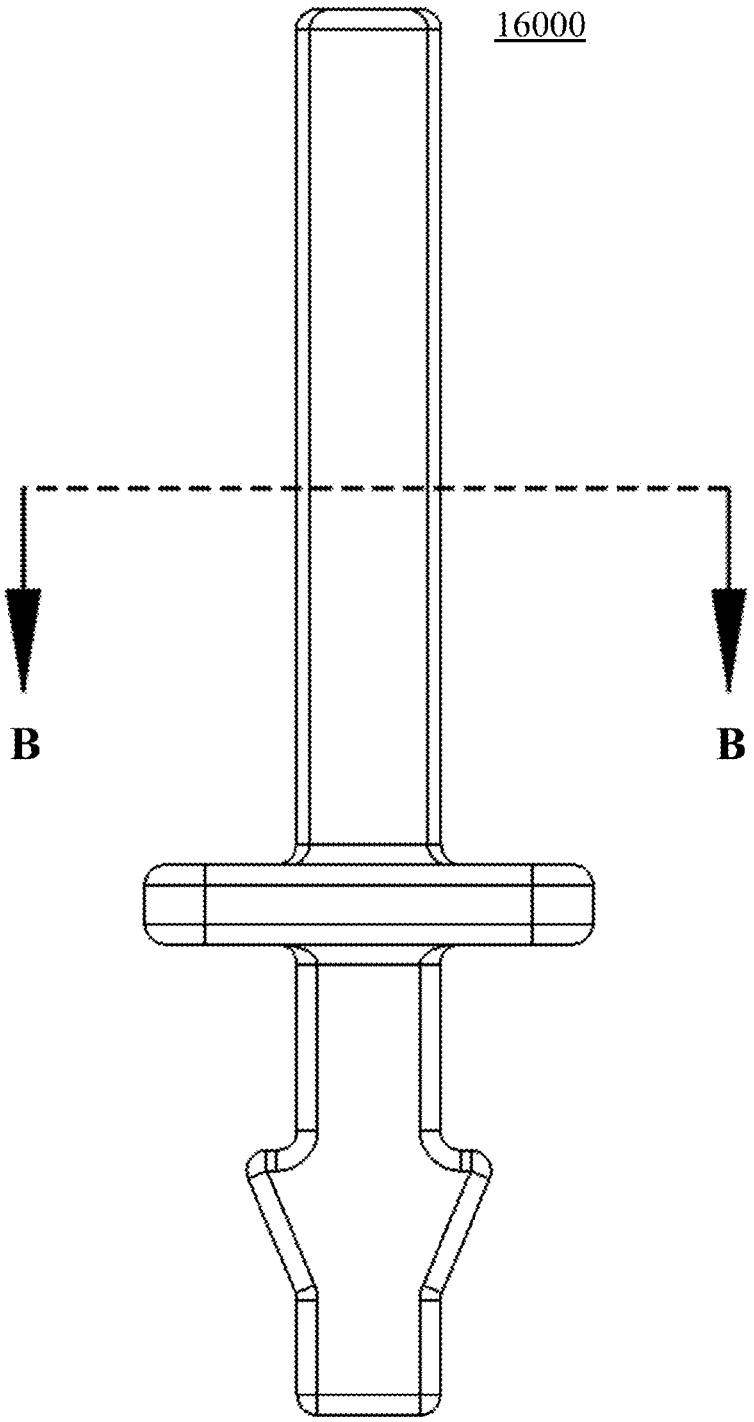

FIG. 16A shows an exemplary gas turbine blade 16000, which for purposes of illustrating certain concepts described herein, can be representative of any gas turbine airfoil, any compressor airfoil, any component of such turbo-machines, or even any casting. FIG. 16B shows a view of blade 16000, from the perspective shown by A-A of FIG. 16A.

Figure 17A:
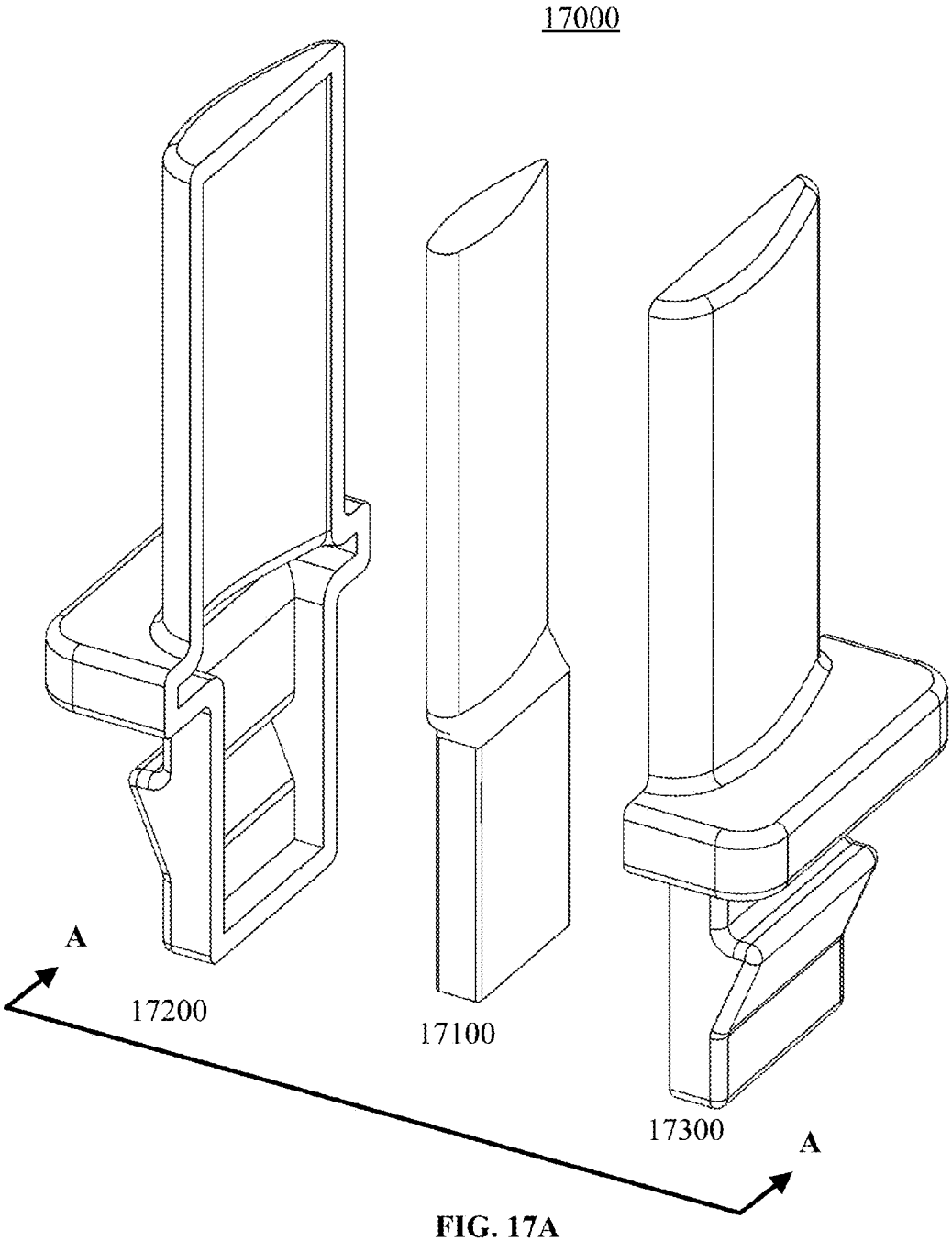
FIGS. 17A and 17B illustrate an exemplary embodiment of a generic cast part.
Figure 17B:
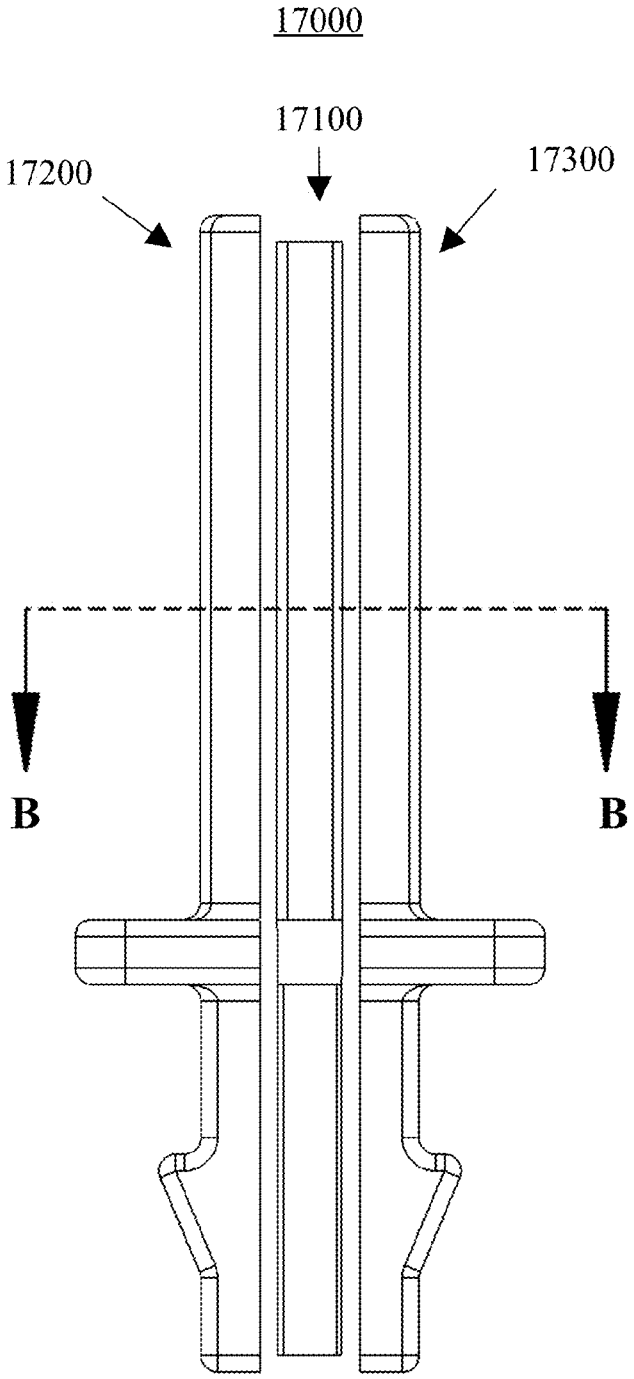

In a process containing steps similar to those of FIGS. 1A-1F, an entire ceramic casting vessel can be produced in sections that are joined together for casting of the alloy. For a hollow component such as the gas turbine blade 17000 illustrated in the assembly view of FIG. 17A, the casting vessel can include a ceramic core 17100 and a shell, which can be formed from one or more portions (e.g., 17200, 17300). Note that the gas turbine blade 17000 of FIG. 17A, is for purposes of illustrating certain concepts described herein, but can be representative of any gas turbine airfoil, any compressor airfoil, any component of such turbo-machines, or even any casting. FIG. 17B shows a view of assembled blade 17000, from the perspective of A-A of FIG. 17A.

Figure 2A:
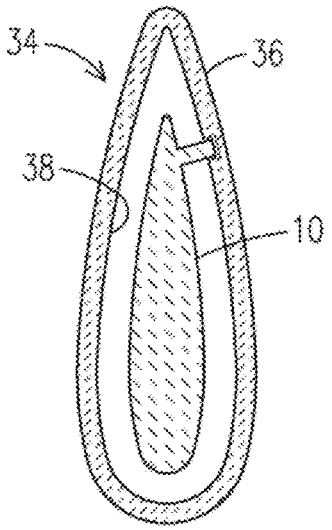
FIG. 2A PRIOR ART
Figure 2B:
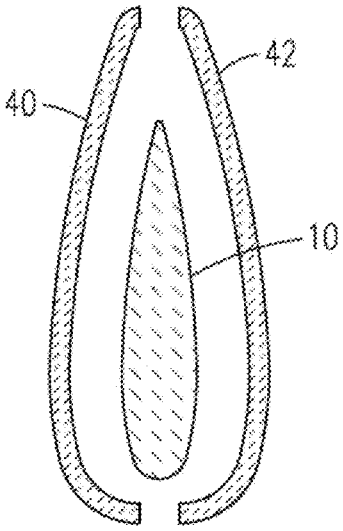
FIG. 2B PRIOR ART
Figure 21:
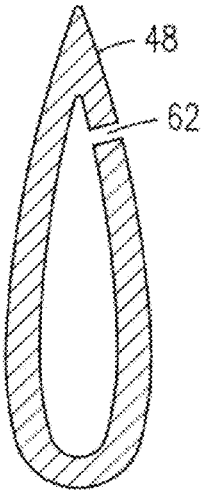
FIG. 21 PRIOR ART

FIGS. 2A-2G illustrate steps in an exemplary embodiment of a method of waxless precision casting of a gas turbine blade. FIGS. 2A, 2G, 2H, and 2I are cross-sectional views of various exemplary embodiments taken at generic section B-B of FIG. 16B. FIGS. 2B and 2C are cross-sectional views of various exemplary embodiments taken at generic section B-B of FIG. 17B. FIG. 2A is a cross-sectional representation of a computerized digital model of a ceramic casting vessel 34 showing an outer shell 36 having an inner surface 38 defining the desired exterior shape of a gas turbine blade and an inner core 10 defining the shape of a hollow center cooling channel of the blade. That digital model can be sectioned as appropriate to facilitate the fabrication of a like-shaped ceramic casting vessel, such as by digitally splitting the shell into suction side 40 and pressure side 42 halves as shown in FIG. 2B. The location of the splits in the digital model can vary for any particular design, and/or can be determined by considering factors such as component stress levels, ease of fabrication and/or assembly of the subsections, the effect of joint lines at a particular location, and/or the ability to design special joint features at a particular location such as reinforcing interlocking joints, etc.

Because the ceramic material utilized to cast the ceramic casting vessel can allow for thermal re-shaping after it has reached the green body state, as discussed above, portions of the digital model optionally can be flattened to facilitate the fabrication of certain designs, such is as shown in FIG. 2C where the shell halves 40, 42 have been digitally flattened. The flattened model can be used to create a flattened ceramic part that can be returned to the desired curvature during an optional thermal shaping process. This effect can be exaggerated to form a wrap-around tab-style locking feature that can be deformed to interface with a cooperating feature to reinforce a joint, for example.

A master tool can be fabricated in the shape of each of the digital model sections 10, 40, 42 of FIG. 2C. As discussed above, the master tool can be fabricated from low cost, easily machined, and/or relatively soft alloy material, such as aluminum. In regions of a tool where a precision geometric detail is desired that can not be effectively produced with standard machining processes, a precision insert 20 can be created and/or inserted into the low cost aluminum tool, as shown in FIG. 2D1, which is a side view of the suction side 40 shell wall of FIG. 2B or FIG. 2C. Alternatively, the entire master tool 44 can be created using a precision process such as a TOMO process, as shown in FIG. 2D2, which is an alternative embodiment of a side view of a suction side shell wall of FIG. 2B or FIG. 2C.

Flexible molds 24 can be derived from each of the master tools as described above with respect to the fabrication of the ceramic core. FIGS. 2E1, 2E2, and 2F are cross-sections views of various exemplary fabrication assemblies. The perspective of these cross-sectional views is similar to that of FIG. 2B, with the exception that FIGS. 2E1, 2E2, and 2F are rotated such that the leading edge is shown on the left side whereas the leading edge is shown on the bottom of FIG. 2B. FIG. 2E1 illustrates a cross-section of a fabrication assembly to create flexible mold 24' using a master tool with geometry replicating an exterior side of an exemplary suction side shell wall 40. FIG. 2E2 illustrates a cross-section of a fabrication assembly to create flexible mold 24" using a master tool with geometry replicating an interior side of an exemplary suction side shell wall 40. Cooperating alignment features 16 can be formed into each of the flexible mold sections to facilitate subsequent assembly of the flexible mold. In lieu of a two-sided master tool, two one-sided master tools can be used in an alternative embodiment. FIG. 2F shows a cross-section of a fabrication assembly that uses flexible molds 24' and 24" to create a void casting cavity 26 into which the suction side shell wall 40 (as shown in FIG. 2B) is cast, such as via low-pressure injection of the ceramic casting material. While FIG. 2E1 and FIG. 2E2 both show the outline of the entire perimeter of 40, the area below 40 in each of these figures can be seen as being solid so that only the exterior of suction side shell wall 40 is replicated in the master tool shown in FIG. 2E1 and only the interior of suction side shell wall 40 is replicated in the master tool shown in FIG. 2E2.

As described above with regard to the casting of the ceramic core, an epoxy-based ceramic casting material having a degree of green body strength can be cast into the flexible mold to allow for the formation of precision complex features on the surfaces of the shell wall. The green body suction side shell wall can be removed from the flexible mold and/or can be joined to its counterpart pressure side shell wall (similarly formed in a separate process) and/or with the separately formed ceramic core to form the ceramic casting vessel 34, as shown in FIG. 2G. International Patent Application PCT/US2009/58220, the contextually relevant portions of which are incorporated by reference herein in their entirety, describes techniques that can be used for forming interlocking mechanical geometries into each shell half to facilitate the joining of the separately cast sections. Alternatively, or in combination with a mechanical interlock, a ceramic adhesive, and/or sintering of the adjoining surfaces can be used to form the joints. The casting vessel can be used to receive molten alloy 46 as shown in FIG. 2H to form the cast alloy gas turbine blade 48 of FIG. 2I.

The above-described waxless precision casting process can produce a ceramic casting vessel for a gas turbine airfoil, blade, or other component without the need for manufacturing a wax pattern tool.

Certain exemplary lost-wax investment casting processes can utilize a dipping process to form the ceramic shell around a wax pattern containing a ceramic core. The dipping process can require repeated dipping of the wax pattern into ceramic slurry, then drying of the thin layer of the slurry that is retained on the dipped structure. This process might take several days to complete. The interior surface of the dried slurry shell can replicate the form of the wax pattern, and on its exterior surface it can create an uncontrolled amorphous shape.

Figure 3B:
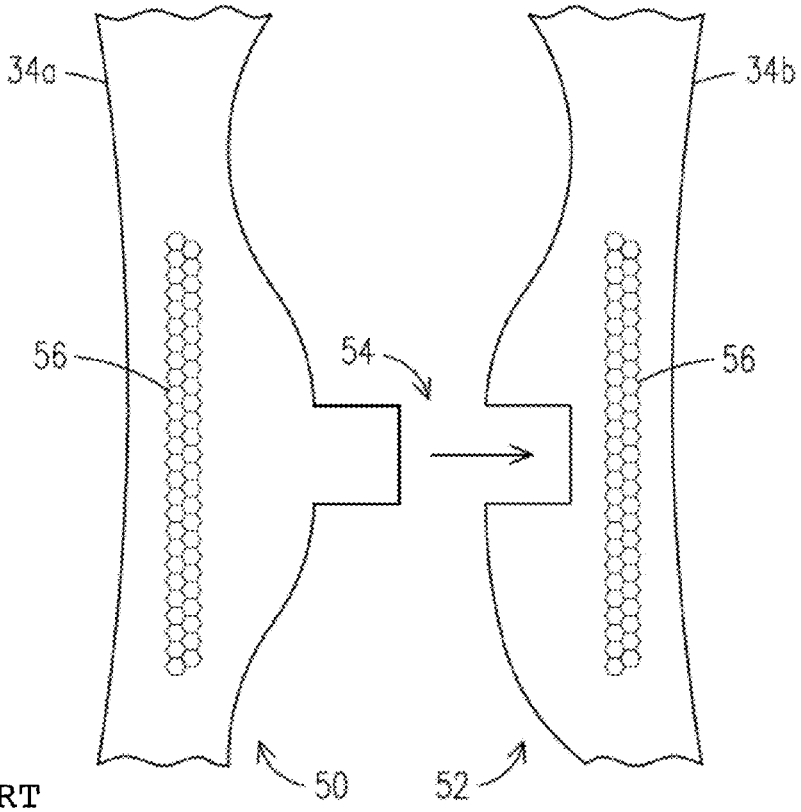
FIG. 3B PRIOR ART
FIGS. 3A and 3B illustrate two ceramic casting vessels.
Figure 3A:
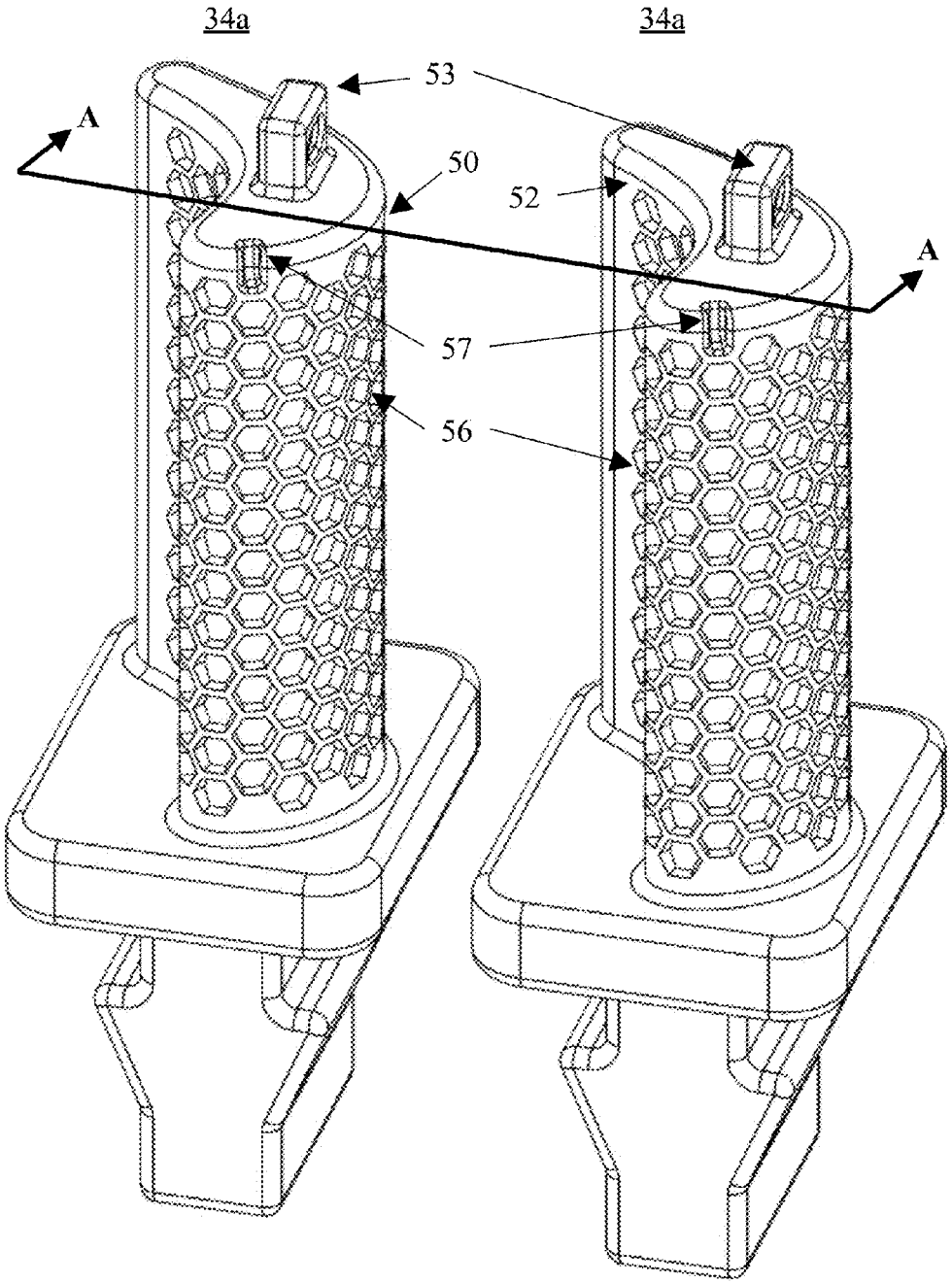
Figure 4:
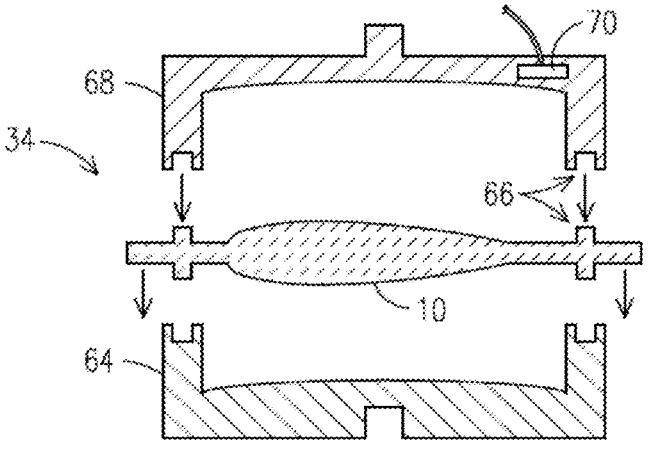
FIG. 4 PRIOR ART
FIG. 4 illustrates an exemplary embodiment of the joining of three pieces of a sectioned ceramic casting vessel.

Via certain exemplary embodiments, a precision cast shell created for a direct shell casting process described herein can allow for the fabrication of engineered shapes/features on either or both of the interior and exterior surfaces of the shell. Such a process can allow the thickness of the shell to be controlled and/or varied along its length. For example, FIG. 3A illustrates side-by-side exemplary ceramic casting vessels 34*a*, 34*b*, and FIG. 3B illustrates a portion of an exemplary cross-section view thereof, taken at section A-A of FIG. 3A, each showing the suction side shell wall 50 of a first gas turbine blade vessel and the pressure side shell wall 52 of a second gas turbine blade. The two shell sections each can have regions of greater or lesser wall thicknesses, such as may be useful for heat transfer considerations and/or stress management. The exterior surface can include a robotic handling connection 53 for automated casting applications, and/or the shell can have a notch and/or other engineered weakness areas 57 that can facilitate the breaking away of the vessel for removal of the cast alloy part. The shell of certain exemplary embodiments can be formed to include features 56, which can increase its strength in particular areas, such as by adding additional material thickness and/or a honeycomb shape at desired locations and/or by embedding a reinforcing material such as an oxide-based woven ceramic fabric and/or alloy mesh or foil during the casting of the shell.

Through-wall cooling holes in gas turbine blades, vanes, and other components can be formed by a material removal process such as EDM and/or drilling after the component is cast without such holes. Certain exemplary embodiments can allow for such holes to be cast directly into the component by including the shape of such holes as prongs extending from the ceramic core and/or the shell. The geometry and/or path of such holes need not be restricted to a circular cross-section and/or a linear form, since the shape can be formed into a master mold via a TOMO process, such as disclosed in International Patent Application PCT/US2009/58220 and/or U.S. Pat. No. 8,813,824, the contextually relevant portions of each of which are incorporated by reference herein in their entirety. The ceramic casting material, such as that described in the same patent application, can exhibit enough green body strength to allow such features to be extracted from a flexible mold and/or to be handled during the assembly of the ceramic casting vessel. One or more prongs 58 extending from a first of the shell or core (illustrated as extending from the core in FIG. 2G) can be designed to abut and/or to be inserted into an indentation 60 formed in a second of the shell or core (illustrated as formed into the shell in FIG. 2G), which can provide mechanical support for the prong during the subsequent molten alloy injection process. A potentially resultant cooling hole 62 is illustrated in FIG. 2I.

Figure 18A:
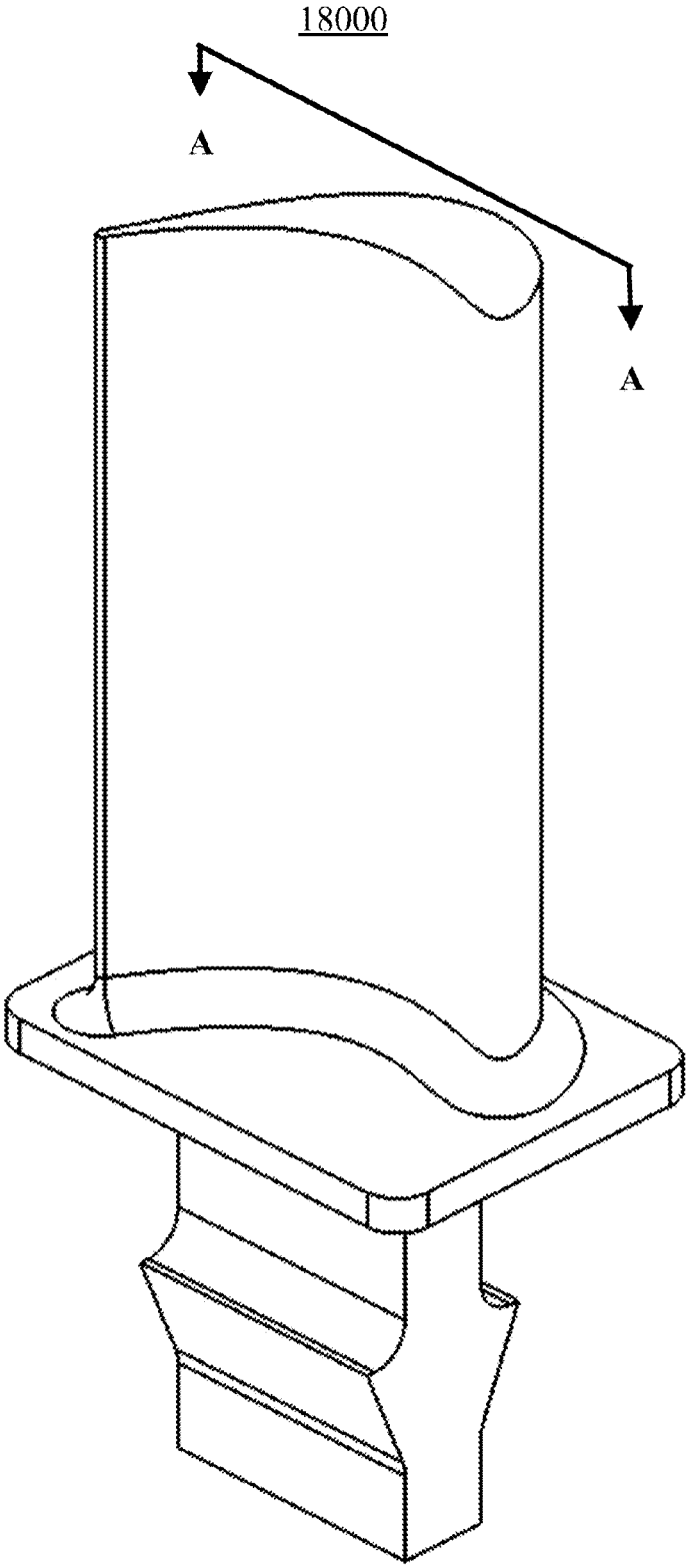
FIGS. 18A, 18B, and 18C illustrate exemplary embodiments of a generic cast part.
Figure 18B:
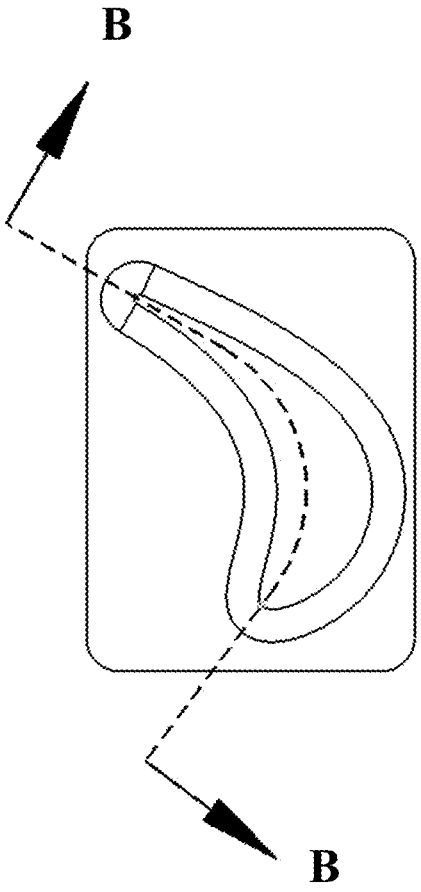
Figure 18C:
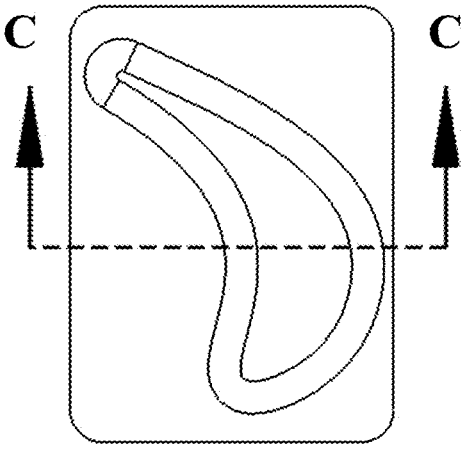

FIG. 18A is a perspective view of an exemplary embodiment of a generic cast part 18000, which for illustration purposes is shown as a turbine airfoil, such as a blade or vane. Note that part 18000 is for purposes of illustrating certain concepts described herein, but can be representative of any gas turbine airfoil, any compressor airfoil, any component of such turbo-machines, or even any casting. FIGS. 18B and 18C show a view of part 18000 from the perspective shown by A-A of FIG. 18A. FIG. 18B shows the basis for section B-B. FIG. 18C shows the basis for section C-C.

Figure 10:
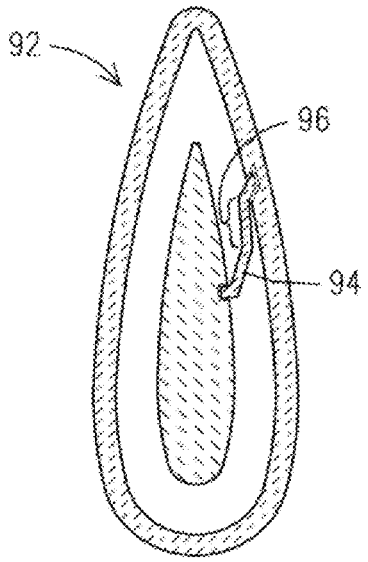
FIG. 10 PRIOR ART
FIG. 10 illustrates an exemplary embodiment of a ceramic casting vessel defining a non-linear cooling channel.
Figure 11:
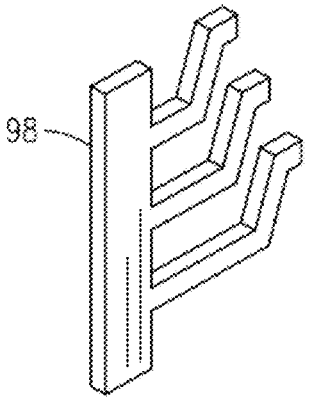
FIG. 11 PRIOR ART
FIG. 11 illustrates an exemplary embodiment of a comb-shaped insert defining the shape of a plurality of non-linear cooling channels.

FIG. 10 illustrates a cross-sectional view, taken e.g., at section B-B of FIG. 16B, of an exemplary ceramic casting vessel 92 that includes a precision formed insert 94 defining the geometry of a non-linear cooling channel that can be formed in a hollow gas turbine airfoil component. The insert can include a portion 96 running generally parallel to a surface of the component, which can increase the effectiveness of the cooling channel. Each insert can define a single cooling channel, or alternatively, a plurality of cooling channels can be defined by an insert 98 formed with a comb design, as illustrated in FIG. 11. Such inserts can be formed to be integral to the core and/or the shell section, and/or can have an end that fits into a mating groove in a core and/or shell section. The insert can be made of a higher strength leachable material, such as silica, quartz, alumina, and/or similar in a separate process and incorporated into the casting vessel accordingly.

In certain exemplary embodiments, airfoil trailing edge cooling channels can be cast using and/or integrating any aspect of the process described in U.S. Pat. No. 7,438,527. Moreover, certain exemplary embodiments can be used when outer walls of an airfoil are less than 0.020".

The flexible molds of FIG. 2F can be derived directly from a TOMO process master mold, such as described in U.S. Pat. Nos. 7,141,812, 7,410,606, and/or 7,411,204, and/or from a low cost aluminum mold having a precision insert formed via a TOMO process. Alternatively, a TOMO process mold and/or other precision master mold can be used to form one or more intermediate molds (not shown), with the intermediate mold(s) being subjected to a further process step that modifies and further enhances the surface topography. In certain exemplary embodiments, an alloy foil master TOMO process mold can be used to cast a first flexible mold, and the first flexible mold can be used to cast a fibrous material intermediate mold. The intermediate mold then can be grit blasted to expose some of the fibers at the surface of the mold. A second flexible mold then can be cast into the intermediate mold, such that the second flexible mold replicates the shape of the exposed fibers as part of its surface topography. The second flexible mold then can be used to cast the shell in FIG. 2F.

Figure 5:
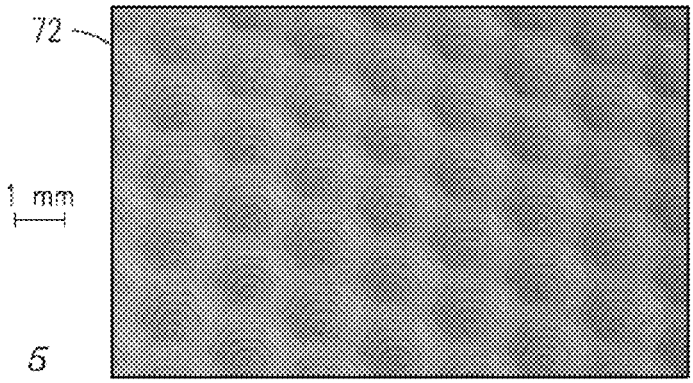
FIG. 5 PRIOR ART
FIG. 5 illustrates an exemplary embodiment of a first patterned surface generated from TOMO-process flexible tooling.

The flexible tooling can be used to generate robust features in the surface of the ceramic shell. These can be relatively low angled and/or of shallow profile, potentially with the objective of creating high angle steps at the edge to create an interlock geometry and/or to increase the surface area of the interface with an overlying coating. A hexagonal type structure and/or honeycomb structure can be used for this purpose. FIG. 5 shows one such surface 72. Such surfaces can produce translatable honeycomb-like surfaces in investment castings, resulting in a periodically rough surface (in the macro range, e.g., approximately 0.002" and above)) that can create a high degree of interlock and/or increased surface area for bond integrity with an overlying coating layer. An additional benefit might be gained from increased intermittent coating thickness across the surface.

Figure 6:
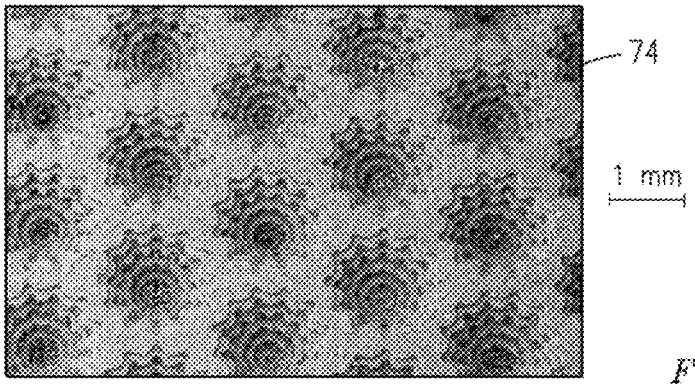
FIG. 6 PRIOR ART
FIG. 6 illustrates an exemplary embodiment of a second patterned surface generated from TOMO-process flexible tooling.
Figure 7:
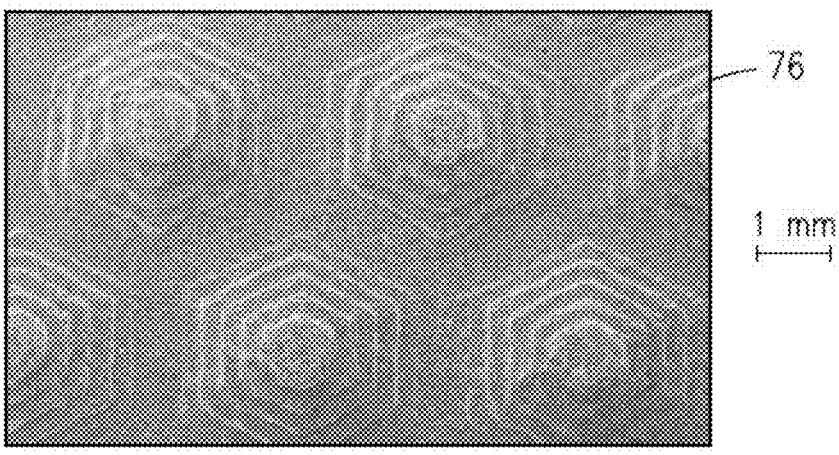
FIG. 7 PRIOR ART
FIG. 7 illustrates an exemplary embodiment of a patterned surface with a protruding surface pattern.
Figure 8A:
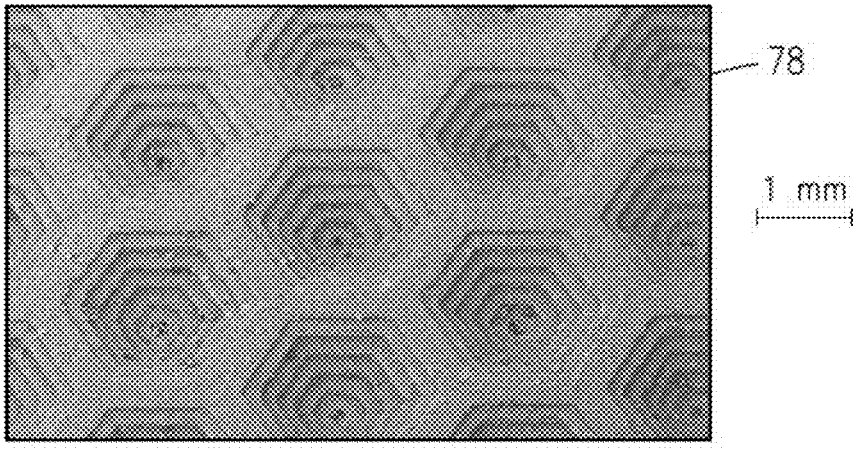
FIG. 8A PRIOR ART
FIG. 8A illustrates an exemplary embodiment of a surface having a depressed surface pattern.
Figure 8B:
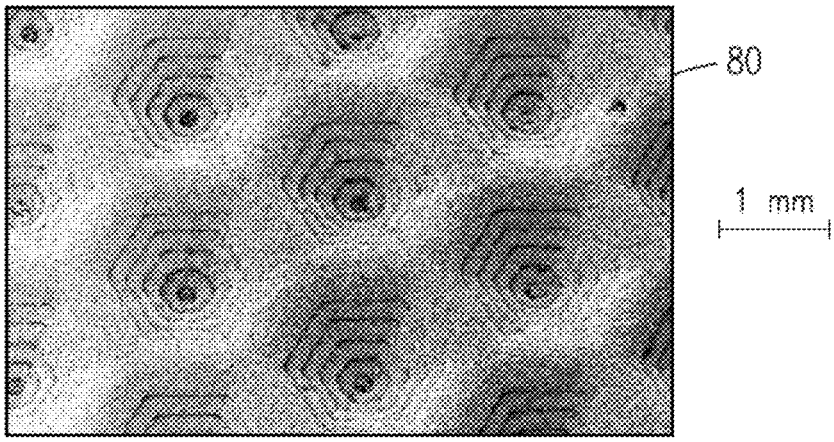
FIG. 8B PRIOR ART
FIG. 8B illustrates an exemplary embodiment of a surface having a depressed surface pattern and undercuts.
Figure 8C:
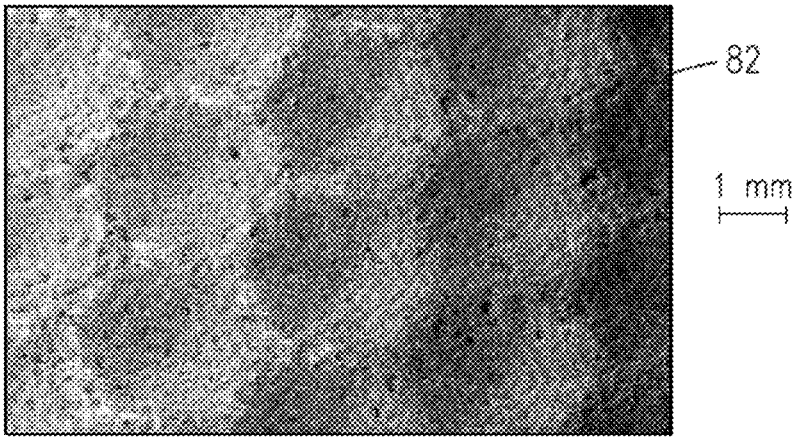
FIG. 8C PRIOR ART
FIG. 8C illustrates an exemplary embodiment of a surface derived from a single master tool subjected to progressive grit blasting.

Additional surface engineering can result in even greater surface area increase and/or interlock, such as seen in FIG. 6, where the edges of a hex shape form are rounded out to form gear-cog type layers 74. Typical surface feature depths have been produced and shown to be effective at both 0.38 mm and 0.66 mm, but these depths do not represent optimization and are not meant to be limiting, since the feature depths can reach the thickness of the mold, core, and/or shell. In areas of high surface angularity (e.g., leading edge and/or trailing edge sections of an airfoil and/or the airfoil/platform intersection), pattern prongs from the surface can be beneficial. Such prongs can be produced from second generation flexible molds (e.g., flexible mold replication from flexible mold masters), such as described in International Patent Application PCT/US2009/58220 and/or U.S. Pat. No. 8,813,824, the contextually relevant portions of each of which are incorporated by reference in their entirety. FIG. 7 shows an example of a protruded surface pattern 76 produced by such a mold technique. Protruding molds can be engineered to produce undercuts in the surface, which thereby can increase the degree of mechanical interlock with the coating. This can be particularly useful in highly stressed areas of coatings. Undercuts can be generated in depressed surface features as well such as those shown in FIG. 6. Protruding and/or depressed surface patterns can provide a benefit of producing a larger aggregate coating thickness when considering the peak height as the nominal coating thickness.

Figure 9:
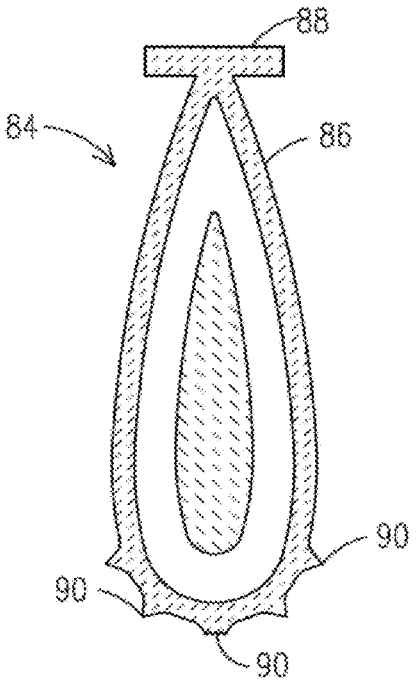
FIG. 9 PRIOR ART
FIG. 9 illustrates an exemplary embodiment of a ceramic casting vessel containing exterior features used during a subsequent dipping process.

FIG. 9 illustrates a cross-sectional view, taken e.g., at section B-B of FIG. 16B, of an exemplary ceramic casting vessel 84 that includes a relatively thin inner primary shell 86 that subsequently can be reinforced with a secondary outer shell structure (not shown—see FIG. 15). The outer secondary shell structure can be a pre-formed structure, with the outer surface of the inner primary shell and/or an inner surface of the pre-formed outer secondary shell structure being cooperatively shaped. Alternatively, the outer secondary shell structure can be formed directly onto the inner primary shell using a dipping process. The inner primary shell can include one or more handling structures 88 that can be used to support the vessel during the dipping process. The inner primary shell can include one or more dipping structures 90 that can impact the flow of the ceramic slurry over the surface and/or the retention of the slurry on the structure during the dipping process.

Core print-outs are sections of the core that extend beyond the finished part geometry. The core lock is where the core print-out interfaces or "locks" with the shell. The core lock is often located on a root print-out. However, the core lock is also sometimes located on a tip print-out. While the concept of a core lock may change and/or go away with a direct shell approach, the concept is still useful for understanding and discussing the orientation of geometry. When the term core-lock is used herein with respect to a direct shell, it refers to the general area of the casting vessel where the portion that defines the interior cavities of the cast metal part (i.e., what is traditionally called the core) meets the portion that defines the outer surfaces of the cast metal part (i.e., what is traditionally called the shell).

FIGS. 12, 13, 14, and 15 are exemplary cross-sectional shapes of exemplary embodiments of generalized cast parts, each cross-section taken at section B-B of FIG. 18B or a section C-C of FIG. 18C. FIGS. 12, 13, 14, and 15 are intended to be broad and general in scope with the left/right sides corresponding to either the leading edge/trailing edge or the pressure/suction sides of an airfoil. Likewise, although some embodiments entail the top (core lock) as being the root of the airfoil, the top also could be interpreted as the tip. Thus, for example, in FIG. 15, if the cast part is a turbine blade, the topmost portion of the part could be visualized as the root of a turbine blade, such that holes 12, 15, and/or 16 are located at or near the tip of the blade. Alternatively, if the core print-out and core lock is located at the tip instead of the root, the topmost portion of the part could be visualized as the tip of the turbine blade. Similarly, the left and right portions of the part can be visualized as the leading edge and trailing edge of the blade or as the suction side and pressure side of the blade. Furthermore, while holes such as 13 and 14 can be interpreted to be axial (i.e., extending in the direction from the root toward the tip), they also can be radial (i.e., extending in the direction from the leading edge toward the trailing edge). The holes also can be positioned such that they exit on the leading edge of the blade.

Figure 12:
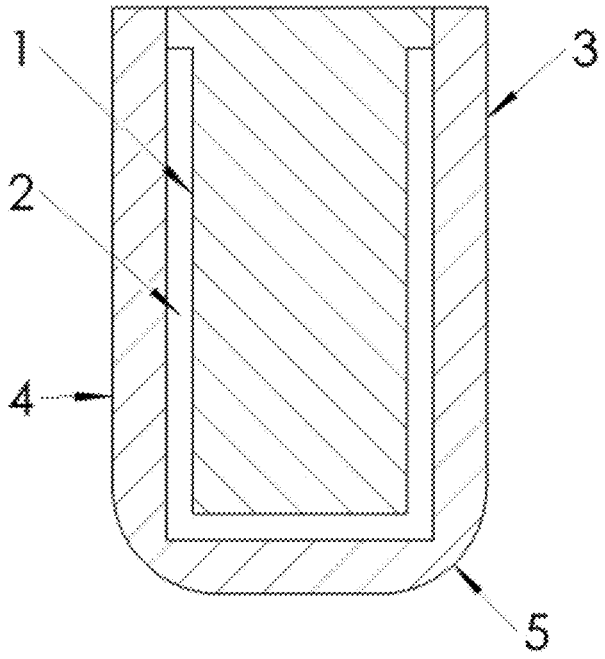
FIGS. 12, 13, 14, and 15 illustrate exemplary cross-sectional shapes of exemplary embodiments of generalized cast parts, each cross-section taken parallel to the longitudinal axis of the part.

An exemplary investment casting is shown in FIG. 12. A ceramic core (1) that will form the interior of a cast metal part can be surrounded by a wax pattern that can form the geometry of the cast metal part. The wax can be melted and/or burned out to form a void (2) that can be filled with molten metal. Before the wax pattern is removed, it can be dipped multiple times in ceramic slurry to coat the pattern with a ceramic shell (3) that forms the exterior of the cast metal piece.

Because the shell dipping process can be heavily affected by gravity, the geometry of the part, and other factors, the thickness of the shell can be difficult to control in all areas. This can lead to the shell being unintentionally thicker in some areas (4) and/or thinner in other areas, such as corners (5). Along with other issues, uncontrolled shell thicknesses can result in uneven cooling, solidification problems, and/or deformation of the shell and cast part. Furthermore, while the dipped shell thickness may sometimes be consistently thin in one area and thick in another, the thickness may also vary from casting to casting and/or create differences in the cast metal parts. Therefore, certain exemplary embodiments can seek to achieve better control of the shell thickness.

Since the core and shell can be heated and cooled rapidly, the shell and the core can be at different temperatures and/or relative sizes to each other. Because of the different temperatures and/or potential changes in ceramic material properties at high temperatures, the core can move relative to the shell during the casting process ("core shift") and/or might need to be carefully attached to the shell so that it does not touch the shell and break. Because of core shift and/or the inability to support the core along its length with respect to the shell during metal casting, the outer wall thicknesses of cast metal parts can be difficult to precisely control, and/or very thin walls can be extremely difficult to create with acceptable casting yields and tolerances. As thin walls can have desirable attributes in many applications, certain exemplary embodiments can connect the core to the shell at multiple locations along the length of the core to better control the cast wall thicknesses.

Furthermore, since the ceramic core and shell can be formed by different processes, they can entail different material properties, such as coefficient of thermal expansion (CTE). Materials with significantly different CTE's will grow and shrink at different rates even when an effort is made to keep them the same temperature by heating or cooling at relatively slower rates. This can cause stress and/or breakage at the interface between the parts with different CTE's and/or prohibit the connection of the core and shell at multiple locations. Therefore, certain exemplary embodiments can create the shell and the core out of the same material or materials with substantially similar CTE's. That is, the shell and core can be formed as a monolithic, integrated, continuous, solid, and/or seamlessly combined part, which is called a "direct shell" herein.

During the metal casting process, the molten metal often creates an outward force that the ceramic shell and core must support without deforming their shapes. Therefore a strong shell can be needed to maintain dimensional accuracy. During metal shrinkage, the cast part shrinks, creating an inward force on both the core and shell. Therefore, the shell and/or the core can be designed and/or formulated to be crushed during this process to avoid creating an unwanted force on the metal, which might interfere with the crystallization and solidification processes. However, sometimes one or both of the shell and core may not be sufficiently crushed during metal shrinkage and a defective part can result. Therefore, certain exemplary embodiments can provide a relatively weak shell to assure metallurgical integrity during solidification. Therefore, certain exemplary embodiments can create geometry and/or material for the shell and/or core that responds more desirably to the forces during metal casting in a non-uniform manner.

Figure 13:
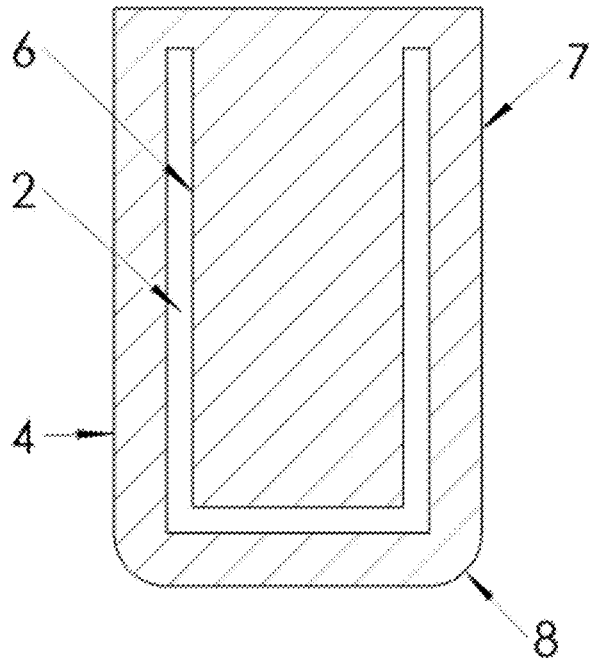

In certain exemplary embodiments, such as shown in FIG. 13, a "direct shell", which can be comprised of a monolithic, integrated, continuous, solid, and/or seamlessly combined core (6) and shell (7), can be cast using one or more fugitive molds (i.e., a mold formed from a material that will be destroyed (e.g., dissolved, shattered, melted, etc.) during removal). The fugitive molds can be produced via TOMO using flexible tooling, from a 3-D printer, and/or through other methods such as traditional wax injection, and then assembled together as required to be used to create the direct shell through a low pressure casting process with a ceramic slurry. The ceramic then can be cured and the fugitive material removed by melting, using a solvent, and/or other methods. The direct shell can have engineered thicknesses at otherwise hard to control areas (8) to properly control cooling and/or solidification of the molten alloy that can fill a void (2) formed by removed material that formed the fugitive mold.

Figure 14:
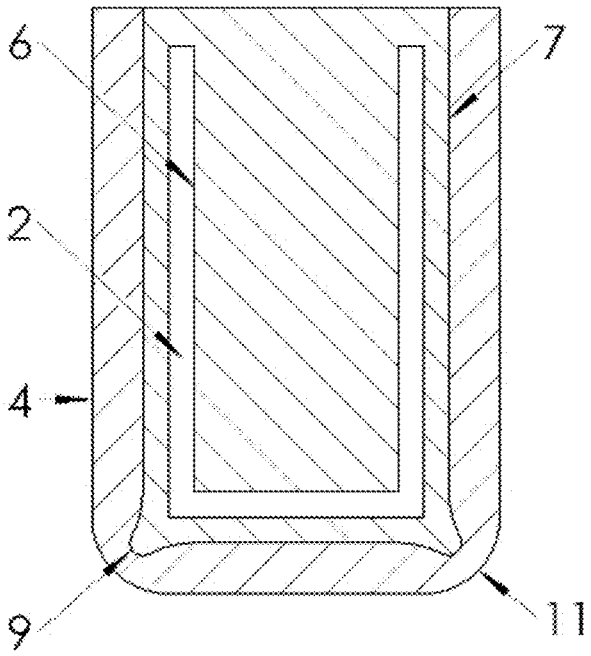

In certain exemplary embodiments, such as shown in FIG. 14, the direct shell, which can be comprised of a monolithic, integrated, continuous, solid, and/or seamlessly combined core (6) and shell (7), can be cast using one or more fugitive molds that can be assembled together as required. To reduce the disruption to the current casting process, the direct shell can be over-dipped in ceramic slurry to form a secondary dipped shell and/or wall on the outside of the primary direct shell. The direct shell can have engineered features at otherwise hard to control areas (9) to compensate for the uneven thickness of the shell properly control cooling and/or solidification.

Figure 15:
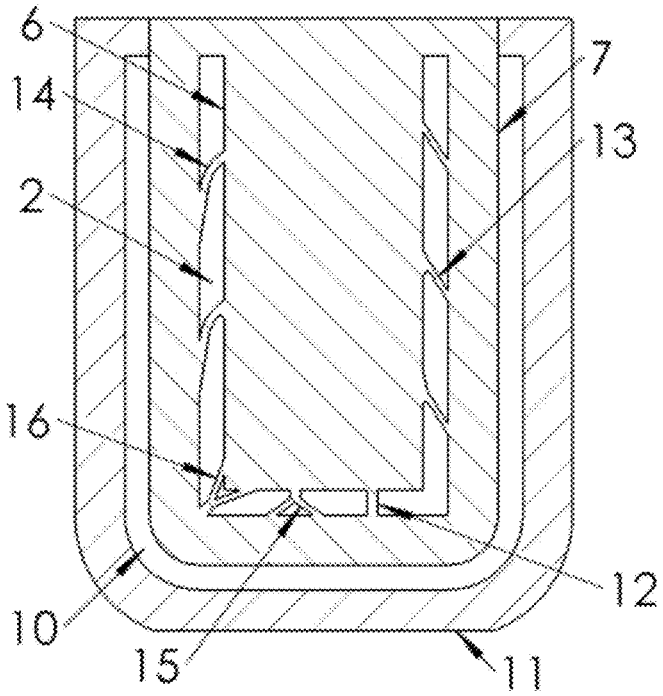

In certain exemplary embodiments, such as shown in FIG. 15, the primary direct shell can be dipped in wax and/or otherwise can be covered in a fugitive (including, but not limited to polymers and polymer-wax mixtures). Care can be taken to leave part of the direct shell uncovered by the fugitive in a similar fashion to the shell locks commonly found on cores. The direct shell covered in a fugitive then can be assembled to the wax runners commonly found in investment casting and/or shelled through a dipping process. The wax and/or other fugitive then can be removed to form a void or gap (10) that can remain between the outer secondary dipped shell and the inner primary direct shell, that gap having a width measured between the outer secondary dipped shell and the inner primary direct shell, as well as a depth and a length, each oriented perpendicular to the width and to each other. The void can be filled with metal during the casting process to create similar and/or substantially equal pressures on the inside and outside of the inner primary direct shell or the void can be left empty.

In certain exemplary embodiments, such as shown in FIG. 15, the fugitive mold pieces used to form the direct shell can have holes in them. These fugitive mold pieces can be printed out of wax, injected using TOMO flexible molds, and/or otherwise created, and/or can entail simple and/or complex hole features. The hole features can be, for example, straight (12), angled (13), and/or curved (14), and/or can consist of one or more passages splitting into two or more passages (15), two or more passages merging into one or more passages (16), and/or other beneficial geometries. The holes can have radii and/or chamfers on the inlets and/or exits as beneficial to control flow, increase the strength of the interface between the integral core (6) and shell (7), and/or reduce stress concentrations and related cracking on the cast metal parts and/or the direct shell. Curved holes might be especially valuable on the leading edge of an airfoil. The holes in the fugitive mold can be left empty to be filled with the same ceramic material as the rest of the direct shell and/or they can be filled with inserts such as the ones shown by (94) and (98) in FIG. 9 and FIG. 10 described previously. These hole features can be positioned along the length of the cast component to connect and limit the relative movement of the sections of the direct shell that form the interior and exterior surfaces of the cast alloy component. These hole features can achieve better control over exterior wall thicknesses and/or create thinner walled parts. Such hole features can reduce or eliminate the need for expensive platinum pins that can be used to maintain the position the core relative to the shell. Such hole features can reduce or eliminate the process of removing material from the cast component to form such holes.

In certain exemplary embodiments, the fugitive between the primary direct shell and the secondary dipped shell can have hole features into which the dipped shell material can come into contact and/or near contact with the direct shell to help support the outward force of the metal on the direct shell during the casting, but not resist the inward force of the metal during shrinkage. The features can be designed such that they slide along and/or near the surface and/or can support the direct shell while allowing it to grow and/or shrink independently of the dipped shell. Alternatively, the features can be designed to constrain and/or support the direct shell at locations in a way that avoids detrimental stress due to the different CTE's.

One method for creating complex features inside a casting shell wall (in effect creating a hollow shell) can begin with a TOMO direct shell mold. A direct shell mold is a ceramic mold used to cast molten metal that is produced using the casting methods and/or materials such as described in International Patent Application PCT/US09/58220. Certain exemplary embodiments can incorporate a ceramic core that can define the internal cooling passages of the airfoil. The ceramic core and/or direct shell can be configured to produce thin outer walls on an airfoil (e.g., having a wall thickness between approximately 0.002" and approximately 0.020", including each and every value and sub-range therebetween). Certain exemplary embodiments can apply a fugitive material to the direct shell. The primary direct shell with applied fugitive material can be integrated into the herein-described shelling operation in which the part is dipped into ceramic slurry to provide a base coat and/or the secondary shell can be built up incrementally to form a vessel, casting system, and/or molding system. Once the outer secondary shell is applied, the fugitive material can be removed leaving behind the inverse geometries on the inner surface of the outer secondary shell, on the outer surface of the inner primary direct shell, and/or on the inner surface of the inner primary direct shell.

In addition to the geometries left behind by the fugitive, there can be one or more portions of the secondary dipped shell that has an interface with the primary direct shell. The interface(s) can support the thin outer wall of the airfoil while it is being cast in metal.

The fugitive material can be applied to the primary direct shell and then a ceramic slurry, such as described herein, can be used to cast or "overcast" the secondary outer shell to form an engineered shell with particular internal geometries that can provide one or more of the characteristics herein described.

The patterned fugitive can be created in a variety of ways. Thin sheet wax, epoxy, or other fugitive material can be stamped and/or rolled with the particular geometries and/or then can be applied to the outer surface of the shell.

In certain exemplary embodiments, a core and primary inner shell can be produced as a single part, but the primary inner shell might define only the inner wall of the overall shell system. A wax pattern then can be applied to the outside surface of the inner wall of the shell system. The wax can be applied with TOMO and/or any other process (injected, rolled, and/or fastened, etc.). The wax pattern can be made as a negative having geometric features such as honeycombs, trusses, caltrops, and/or meshes, etc. The features can be designed and/or formed with dimensional control that systematically effects the overall strength of the casting mold and/or the crushability of the mold after the metal is cast and/or solidified in the mold. The features can be formed in such a way that the strength and/or crushability is specific to predetermined areas of the metal casting, such as the leading edge of the airfoil, the trailing edge of the airfoil, and/or the root area, etc., but potentially with the primary intention and/or effect of forming very thin outer walls of the airfoil casting. Certain exemplary embodiments can provide for control of features such as width, thickness, length, aspect ratio, shape, and/or feature interconnections, such as fillets, chamfers, and/or other connecting schemes. Because the wax material ultimately can be removed during the investment casting process, either during hot metal casting, pre-fire or mold heating, and/or shell fire, etc., the features can be formed with exit channels, which can allow the wax to drain and/or exit the shell area during the casting process. The exit features can be incorporated as part of the overall geometric system for enabling higher primary inner shell strength and/or controlled crushability during metal casting. Once the wax is applied to the outer surface of the primary inner shell, the outer wall of the shell system (which can be, or can be part of, the outer secondary shell) then can be applied over the wax pattern. The application of the outer secondary shell can be via ceramic dipping or any other method of applying material to form the outer wall of the shell system. Once the outer wall material is applied to form the outer secondary shell, the wax pattern then can be melted, dissolved, and/or removed. The outer secondary shell material, which can fill the open areas of the wax pattern during its application, next can be fused to the inner primary shell and/or the outer material can create positive features between the outer secondary shell and the inner primary shell walls, potentially forming a complex shell structure and/or system that has a inner primary shell and/or wall, a patterned wall (primary and/or secondary), an interconnecting section in the middle, and/or aa outer secondary shell and/or wall.

In certain exemplary embodiments, a core and inner primary shell first can be produced as a single part, but the inner primary shell might define only the inner wall of the shell system, and/or both the core and inner primary shell might be made from the same ceramic material. A wax pattern then can be applied to the outside surface of the inner wall of the shell system, the wax can be applied (e.g., with TOMO or any other process), and/or any features described above can be formed. Once the wax has been applied to the outer surface of the inner primary shell, the outer wall of the shell system then can be applied over the wax pattern. The application of the outer secondary shell can be via ceramic dipping or any other method of applying material to form the outer secondary wall of the shell system. The outer secondary shell or its wall can be produced from a different material than the core and inner primary shell, which can provide additional control to effect shell strength and/or crushability for thin wall metal airfoil castings. By using different materials for the outer secondary shell and the inner primary shell and/or the walls of the shell system, the mechanical and/or thermal properties of the shells and/or their walls can be designed to work as a shell system, which can effect mold filling, casting flow, and/or solidification of the metal. The system can include patterned features between the secondary outer and primary inner shells and/or their walls (e.g., prongs, holes, etc.), can have an open air gap between the walls/shells, and/or be connected with no features and/or no gap between them. The outer wall can be a ceramic and/or any other high temperature material, such as a metal and/or composite of a metal and ceramic. The outer wall material can contain nano-scale particles mixed with larger particles of the same material and/or different materials. The outer wall material can have fillers and/or dopants that can be used in the metal foundry industry.

In certain exemplary embodiments, a core and inner primary shell first can be produced as a single part, but the inner primary shell might define only the inner wall of the shell system, and/or the core might have features and/or prongs that extend from the outer surface of the core to the inner surface of the inner wall of the shell system (and/or from the inner surface of the inner wall of the shell system to the outer surface of the core), where the prongs ultimately can form cooling holes in the metal cast airfoil. Such prongs, which can structurally connect the shell to the core, can be formed, for example, as described in International Patent Application PCT/US2009/58220 and/or U.S. Pat. No. 8,813,824, the contextually relevant portions of each of which are incorporated by reference herein in their entirety. A wax pattern then can be applied to the outside surface of the inner wall of the shell system, the wax can be applied with TOMO or any other process, and/or any features described above can be formed. Once the wax is applied to the outer surface of the inner shell, the outer wall of the shell system then can be applied over the wax pattern using any material and/or method as described above. The cooling hole prongs can be designed and/or constructed with a geometry that allows air to exit the turbine airfoil, and/or can be designed and/or constructed to work in concert mechanically and/or thermally with the outer shell walls and/or middle shell patterned area to effect the shell strength and/or crushability of the shell during casting for airfoils with thin outer walls (e.g., from approximately 0.002" to approximately 0.020" thick, including each and every value and subrange therebetween).

Thus, certain exemplary embodiments can provide a manufacturing process that can produce, potentially in high volume, complex, monolithic, and/or solid net-shape (i.e., formed to the designed configuration, with no secondary finishing operations necessarily required), and/or micro-scale (i.e., with two or more orthogonal dimensions measuring in a range of approximately sub-micron to approximately 25 microns (including each and every value and sub-range therebetween)) to meso-scale (i.e., with two or more orthogonal dimensions measuring in a range of approximately 25 microns to approximately 100 millimeters (including each and every value and sub-range therebetween)) structures, such as from advanced materials comprised of, for example, powdered metals, metal alloys, ceramics, and/or polymers, etc. This process, which is described in U.S. Pat. No. 7,893,413 and/or U.S. Patent Publication US 20110189440 (the contextually relevant portions of each of which are incorporated by reference herein in their entirety), and which is sometimes referred to herein as TOMO-Lithographic-Molding (TLM™) or TOMO™, can utilize a high-resolution master tool constructed from lithographically micro-machined layers, precisely aligned, stack laminated, and/or bonded. By combining dissimilarly patterned layers or "toma", 3D cavities of otherwise unattainable sophistication and/or precision can be created. Combining these disciplines with certain casting and/or forming methods can enable the production of cost effective, high aspect-ratio devices and/or systems with features ranging from micro-scale to meso-scale. Any number of micro-scale and/or meso-scale features and/or structures in varied distributions and/or customized geometries can be arrayed upon any size surface, such as large (e.g., approximately 1 square foot to approximately 10,000 square meters or larger), planar and/or non-planar, continuous and/or arrayed, surfaces. These surfaces may, in turn, be used as plies in a macro-scale (i.e., with one or more orthogonal dimensions measuring greater than 100 millimeters), laminate and/or composite structure for potentially optimizing physical properties.

Exemplary structures, components, and/or devices that can be manufactured by the certain exemplary processes can include components of rotating machines, such as turbines, turbine engines, compressors, pumps, etc., those components potentially including turbine blades, vanes, buckets, nozzles, shrouds, etc., and/or devices and/or systems used to create such components. Further structures, components, and/or devices that can be manufactured using certain exemplary casting processes described herein can include at least one:

accelerometer
actuator
airway
amplifier
antenna
aperture
application specific microinstrument
atomizer
balloon catheter
balloon cuff
beam
beam splitter
bearing
bioelectronic component
bio-filter
biosensor
bistable microfluidic amplifier
blade passage
blower
bubble
capacitive sensor
capacitor
cell sorting membrane
chain
channel
chromatograph
clip
clutch
coextrusion
coil
collimator
comb
comb drive
combustor
compression bar
compressor
conductor
cooler
corrosion sensor
current regulator
density sensor
detector array
diaphragm
diffractive grating
diffractive lens
diffractive phase plate
diffractor
diffuser
disc
display
disposable sensor
distillation column
drainage tube
dynamic value
ear plug
electric generator
electrode array
electronic component socket
electrosurgical hand piece
electrosurgical tubing
exciter
fan
fastener
feeding device
filter
filtration membrane
flow passage
flow regulator
fluid coextrusion
fluidic amplifier
fluidic oscillator
fluidic rectifier
fluidic switch
foil
fuel cell
fuel processor
fuse
gear
grating
grating light valve
gyroscope
hearing aid
heat exchanger
heater
high reflection coating
housing
humidity sensor
impeller
inducer
inductor
infra-red radiation sensor
infusion sleeve
infusion test chamber
interferometer
introducer sheath
introducer tip
ion beam grid
ion deposition device
ion etching device
jet
joint
lens
lens array
lenslet
link
lock
lumen
manifold
mass exchanger
mass sensor
membrane
microbubble
microchannel plate
microcombustor
microlens
micromirror
micromirror display
microprism
microrelay
microsatellite component
microshutter microthruster
microtiterplate
microturbine
microwell
mirror
mirror display
mixer
multiplexer
nozzle
optical attenuator
optical collimator
optical switch
ordinance control device
ordinance guidance device
orifice
phase shifter
photonic switch
pin array
plunger
polarizer
port
power regulator
pressure regulator
pressure sensor
printer head
printer head component
prism
processor
processor socket
propeller
pump
radiopaque marker
radiopaque target
rate sensor
reaction chamber
reaction well
reactor
receiver
reflector
refractor
regulator
relay
resistor
resonator
RF switch
rim
safe-arm device
satellite component
scatter grid
seal
septum
shroud
shunt
shutter
spectrometer
stent
stopper
supercharger
switch
tank
temperature regulator
temperature sensor
thruster
tissue scaffolding
titerplate
transmission component
transmitter
tunable laser
turbine
turbocharger
ultra-sound transducer
valve
vane
vessel
vibration sensor
viscosity sensor
voltage regulator
waveplate
well
wheel
wire coextrusion Included among the many contemplated industries and/or fields of use for such structures, components, and/or devices are:

Aerospace
Automotive
Avionics
Biotechnology
Chemical
Computer
Consumer Products
Defense
Electronics
Manufacturing
Medical devices
Medicine
Military
Optics
Pharmaceuticals
Process
Security
Telecommunications
Transportation Included among the many contemplated technology areas for such structures, components, and/or devices are:

Acoustics
Active structures and surfaces
Adaptive optics
Analytical instrumentation
Angiography
Arming and/or fusing
Bio-computing
Bio-filtration
Biomedical imaging
Biomedical sensors
Biomedical technologies
Cardiac and vascular technologies
Catheter based technologies
Chemical analysis
Chemical processing
Chemical testing
Communications
Computed tomography
Computer hardware
Control systems
Data storage
Display technologies
Distributed control
Distributed sensing
DNA assays
Electrical hardware
Electronics
Fastener mechanisms
Fluid dynamics Fluidics
Fluoroscopy
Genomics
Imaging
Inertial measurement
Information technologies
Instrumentation
Interventional radiography
Ion source technologies
Lab-on-a-chip
Measurements
Mechanical technologies
Medical technologies
Microbiology
Micro-fluidics
Micro-scale power generation
Non-invasive surgical devices
Optics
Orthopedics
Power generation
Pressure measurement
Printing
Propulsion
Proteomics
Radiography
RF (radio frequency) technologies
Safety systems
Satellite technologies
Security technologies
Signal analysis
Signal detection
Signal processing
Surgery
Telecommunications
Testing
Tissue engineering
Turbomachinery
Weapon safeing Certain exemplary embodiments can provide a system, machine, device, manufacture, and/or composition of matter configured for and/or resulting from, and/or a method for, activities that can comprise and/or relate to, investment casting an airfoil in a mold, the airfoil comprising at least one wall, the wall having a thickness within the range of 0.008 inches to 0.015 inches, the mold comprising a core, an inner primary shell, and an outer secondary shell, the core seamlessly combined with the inner primary shell and integral with the inner primary shell yet substantially separated from the inner primary shell by one or more core gaps, the inner primary seamlessly combined with the outer secondary shell and integral with the outer secondary shell yet substantially separated from the outer secondary shell by one or more shell gaps, wherein:

the one or more core gaps receive molten metal at substantially the same time as the one or more shell gaps;

each of the one or more core gaps is defined by a length, a width that is perpendicular to the length, and a thickness that is perpendicular to the length and the width;

the thickness of each core gap varies in a predetermined manner along the length and/or width of that core gap;

the inner primary shell is defined by a length, a width that is oriented orthogonal to the length, and a thickness that is oriented orthogonally to the length and the width; and the thickness varies in a predetermined manner along the length and/or width of the inner primary shell;

each of the one or more shell gaps is defined by a length, a width that is perpendicular to the length, and a thickness that is perpendicular to the length and the width;

the thickness of each shell gap varies in a predetermined manner along the length and/or width of that shell gap;

the outer secondary shell is defined by a length, a width that is oriented orthogonal to the length, and a thickness that is oriented orthogonally to the length and the width;

the thickness varies in a predetermined manner along the length and/or width of the outer secondary shell;

the inner primary shell comprises a plurality of features that are configured to increase a strength of the inner primary shell in predetermined portions of the inner primary shell;

the inner primary shell comprises a plurality of features that each have a predetermined shape and each located at a predetermined location;

the inner primary shell comprises a plurality of surface features that are configured to increase a surface area of the inner primary shell;

the inner primary shell comprises a plurality of surface features that are configured to increase a surface roughness at periodic locations on a surface of the inner primary shell;

the inner primary shell comprises a plurality of surface features that each define an undercut in a surface of the inner primary shell;

the inner primary shell comprises a handling connection configured for automated casting;

the inner primary shell and/or outer secondary shell comprises an engineered weakness area configured for facilitating a breaking away of the inner primary shell for removal of the cast airfoil;

the inner primary shell comprises a plurality of surface features that each have a depth within the range of 0.38 mm and 0.66 mm;

the inner primary shell and core are formed from a different material than the outer secondary shell;

the outer secondary shell is formed via a dipping process;

the mold comprises a plurality of prongs that extend between and seamlessly connect the core and the inner primary shell, the plurality of prongs defining a corresponding plurality of film cooling holes in the airfoil, each of the plurality of prongs defines a fillet having a predetermined radius, the fillet located at an intersection of the prong and the inner primary shell or at an intersection of the prong and the core; and/or the mold comprises a plurality of prongs that extend between and seamlessly connect the core and the inner primary shell, the plurality of prongs defining a corresponding plurality of film cooling holes in the airfoil, each of the plurality of holes defines a single passage that transitions to two or more passages.

DEFINITIONS

When the following terms are used substantively herein, the accompanying definitions apply. These terms and definitions are presented without prejudice, and, consistent with the application, the right to redefine these terms via amendment during the prosecution of this application or any application claiming priority hereto is reserved. For the purpose of interpreting a claim of any patent that claims priority hereto, each definition in that patent functions as a clear and unambiguous disavowal of the subject matter outside of that definition.

3-dimensional/three-dimensional—involving or relating to three mutually orthogonal dimensions and/or definable via coordinates relative to three mutually perpendicular axes.

a—at least one.

account—to accommodate, adjust for, and/or take into consideration.

activity—an action, act, step, and/or process or portion thereof adapted to—suitable, fit, and/or capable of performing a specified function.

adapter—a device used to effect operative compatibility between different parts of one or more pieces of an apparatus or system.

adjacent—in close proximity to, near, next to, and/or adjoining after—subsequent to.

airfoil—a body, cross-section of a body, and/or surface designed to develop a desired force by reaction with a fluid that is flowing across the surface. The cross sections of wings, propeller blades, windmill blades, compressor and turbine blades in a jet engine, and hydrofoils on a high-speed ship are examples of airfoils.

align—to adjust substantially into a proper orientation and/or location with respect to another thing and/or to place objects such that at least some of their faces are in line with each other and/or so that their centerlines are on the same axis.

all—an entirety of a set.

alloy—an amalgam, homogeneous mixture, and/or solid solution of a metal and a non-metal, and/or of two or more metals, the atoms of one replacing or occupying interstitial positions between the atoms of the other.

along—through, on, beside, over, in line with, and/or parallel to the length and/or direction of; and/or from one end to the other of.

along—through, on, beside, over, in line with, and/or parallel to the length and/or direction of; and/or from one end to the other of.

alumina—aluminum oxide and/or $Al_2O_3$.

amount—a quantity.

ancestor—an entity from which another entity is descended; a forebear, forerunner, predecessor, and/or progenitor.

and—in conjunction with.

and/or—either in conjunction with or in alternative to.

angle—a measure of rotation and/or inclination between a ray and a reference ray and/or plane.

any—one, some, every, and/or all without specification.

aperture—an opening, hole, gap, passage, and/or slit.

apparatus—an appliance and/or device for a particular purpose.

applying—to put to use for a purpose.

approximately—about and/or nearly the same as.

are—to exist.

area—the measure of the space within a 2-dimensional region.

around—about, surrounding, and/or on substantially all sides of array—an arrangement of multiple units, usually ordered; an array may be organized in linear, curvilinear, flat, and/or 3-dimensional positioning of the multiple units.

artifact—structural evidence indicative of one or more molds from which a molded object descended.

associate—to join, connect together, accompany, and/or relate.

associated with—related to.

at—in, on, and/or near.

at least—not less than, and possibly more than.

at least one—not less than one, and possibly more than one.

attach—to fasten, secure, couple, and/or join.

automate—to cause to act or operate in a manner essentially independent of external and/or manual influence or control.

away—on a path directed from a predetermined location.

axis—a straight line about which a body and/or geometric object rotates and/or can be conceived to rotate and/or a center line to which parts of a structure and/or body can be referred.

base—a supporting and/or mounted portion of an item.

be—to exist in actuality.

between—in a separating interval and/or intermediate to.

bind—to combine chemically or form a chemical bond.

binder—a substance and/or something used to bind separate particles together and/or facilitate adhesion.

blade—an arm of a rotating mechanism.

blend—to visually, spatially, and/or physically combine, unite, mix, mingle, fuse, meld, and/or merge into one.

blind hole—a hole that is not a through-hole and/or does not to all the way through something.

bottom—a lowermost and/or innermost point.

bound—to limit an extent.

break—to cause to separate into pieces suddenly and/or violently, and/or to crack, fracture, smash, snap off, and/or detach.

by—via and/or with the use or help of.

can—is capable of, in at least some embodiments.

cast—(n) the process and/or act of casting; (adjective) formed in a mold; (v) to form (e.g., wax, liquid polymer, and/or liquid metal, etc.) into a particular shape by pouring into a mold and allowing to solidify within the mold prior to removal from the mold.

cause—to bring about, provoke, precipitate, produce, elicit, be the reason for, result in, and/or effect.

cavity—a hollow area within an object.

ceramic—any of various hard, brittle, heat-resistant, and corrosion-resistant materials made by shaping and then firing a nonmetallic mineral, such as clay, at a high temperature, and/or the nonmetallic mineral from which such materials can be formed, such as, for example, silica, silicon carbide, alumina, zirconium oxide, and/or fused silica, calcium sulfate, luminescent optical ceramics, bio-ceramics, and/or plaster, etc.

change—(v.) to cause to be different; (n.) the act, process, and/or result of altering or modifying.

channel—a defined passage, conduit, and/or groove for conveying one or more fluids.

characterize—to define, describe, classify, and/or constrain the qualities, characteristics, and/or peculiarities of circular—round and/or having the shape of a circle.

close—to move (a door, for example) so that an opening or passage is covered and/or obstructed; to shut; and/or to draw and/or bind together.

coat—(v) to apply a thin layer of material to cover at least a portion of a surface of something. In some cases, upon application, a mechanical, physical, and/or chemical attachment, bond, and/or interaction can form between the materials. Examples include conventional coating processes such as spraying and/or dipping; vacuum deposition techniques; and/or such surface-modification technologies as diffusion, laser and/or plasma processes, chemical plating, grafting and/or bonding, hydrogel encapsulation, and/or bombardment with high-energy particles.

combine—to bring together and to create substantial contact therebetween, e.g., to attach, unite, mix, intersect, interleave, merge, collide, interface, and/or otherwise join.

component—a constituent element and/or part.

composite—a product made of diverse materials, each of which is identifiable, at least in part, in the final product.

composition—a composition of matter and/or an aggregate, mixture, compound, reaction product, and/or result of combining two or more substances.

compressive—pertaining to forces on a body or part of a body that tend to crush and/or compress the body.

comprised—included in; a part of.

comprises—includes, but is not limited to, what follows.

comprising—including but not limited to.

concentration—a measure of the amount of dissolved substance contained per unit of volume and/or the amount of a specified substance in a unit amount of another substance.

configure—to make suitable or fit for a specific use or situation.

connect—to link, join, and/or fasten together.

connection—a physical link between two or more elements of a system.

consumable—adapted to be destructively mechanically and/or chemically removed, destroyed, and/or decomposed.

containing—including but not limited to.

convert—to transform, adapt, and/or change.

cool—to reduce a temperature of a substance.

cooling—reducing a temperature of a substance.

core—a substantially innermost and/or central, and potentially removable, object around which another material will be cast.

corresponding—related, associated, accompanying, similar in purpose and/or position, conforming in every respect, and/or equivalent and/or agreeing in amount, quantity, magnitude, quality, and/or degree.

countersink—to enlarge an opening region (entrance or exit) of a hole.

coupleable—capable of being joined, connected, and/or linked together.

coupling—(n) a device adapted to join, connect, and/or link. (v) joining, connecting, and/or linking coupling—linking in some fashion.

crack—A partial split or break and/or a fissure.

create—to make, form, produce, generate, bring into being, and/or cause to exist.

cristobalite—a crystalline form of silica that tends to be stable at high temperatures and/or a polymorph of quartz.

cross-link—to join (adjacent chains of a polymer or protein) by creating covalent bonds.

cross-section—a section formed by a plane cutting through an object at a right angle to an axis.

crystal structure change—a transition from one polymorph of a solid material to another.

curvature—the act of curving and/or or the state and/or degree of being curved and/or bent.

curved—smoothly bent, not linear, and/or to move in and/or take the shape of a curve.

cycloaliphatic—of, relating to, and/or being an organic compound that contains a ring but is not aromatic.

de-mold—to remove from a mold.

define—to establish the meaning, relationship, outline, form, and/or structure of; and/or to precisely and/or distinctly describe and/or specify.

densify—to increase the density of.

depth—an extent, measurement, and/or dimension downward, backward, inward, and/or orthogonal to length and/or width.

derive—to obtain from a source.

desired—indicated, expressed, and/or requested.

destructively—of, relating to, and/or being a process that results in damage to the subject material and/or product and/or results in such damage that the subject material and/or product can not be re-used for its intended purpose.

determine—to find out, obtain, calculate, decide, deduce, ascertain, and/or come to a decision, typically by investigation, reasoning, and/or calculation.

device—a machine, manufacture, and/or collection thereof differ—to be unlike, dissimilar, separate, changed, and/or distinct in nature and/or quality.

different—changed, distinct, and/or separate.

digital—non-analog and/or discrete.

dimension—an extension in a given direction and/or a measurement in length, width, or thickness.

dimpled—having one or more slight depressions and/or indentations in a surface.

dip—to plunge briefly into a liquid, as in order to wet, coat, and/or saturate, and/or to immerse, potentially repeatedly.

direction—a spatial relation between something and a course along which it points and/or moves; a distance independent relationship between two points in space that specifies the position of either with respect to the other; and/or a relationship by which the alignment and/or orientation of any position with respect to any other position is established.

disintegrate—to become reduced to components, fragments, and/or particles.

dissolve—to cause to pass into solution.

each—every one of a group considered individually.

Embodiment—an implementation, manifestation, and/or a concrete representation, such as of a concept.

engineered—intentional and/or predetermined.

entry—an opening, way in, and/or path leading through an opening and toward an interior.

epoxy—having the structure of an epoxide; of and/or containing an oxygen atom joined to two different groups that are themselves joined to other groups; any of a class of resins derived by polymerization from epoxides: used chiefly in adhesives, coatings, electrical insulation, solder mix, and/or castings; and/or any of various usually thermosetting resins capable of forming tight cross-linked polymer structures characterized by toughness, strong adhesion, and low shrinkage, used especially in surface coatings and adhesives.

estimate—(n) a calculated value approximating an actual value; (v) to calculate and/or determine approximately and/or tentatively.

exemplary—serving as an example, model, instance, and/or illustration.

exit—an egress, way out, a path leading through an opening and away from an interior of a container.
expected—predicted.
extend—to stretch, cover, span, and/or reach spatially outward.
extending—existing, spanning, covering, reaching, located, placed, and/or stretched lengthwise and/or in an indicated direction.
exterior—a region that is external and/or outside of a device and/or system.
external—exterior and/or relating to, existing on, and/or connected with the outside and/or or an outer part.
face—the most significant or prominent surface of an object.
facilitate—to encourage, allow, and/or help bring about.
fasten—to attach to something else and/or to hold something in place.
fatigue—the weakening or failure of a material resulting from prolonged stress.
feature—a prominent and/or distinctive aspect, structure, component, quality, and/or characteristic.
fiducial—a tactile and/or visual marking and/or reference point.
fill—to supply, introduce into, and/or put into a container, potentially to the fullest extent of the container.
fillet—a concave easing of an interior corner of a part, a substantially rounded corner, and/or an intersection between parts, the fillet adapted to: distribute stress over a broader area; effectively make the parts more durable and/or capable of bearing larger loads; and/or improve fluid dynamics (e.g., reduce drag and/or turbulence) at the corner and/or intersection. A fillet can be defined by one or more radii and/or one or more line segments.
film—a thin layer, covering, and/or coating.
filtering—adapted for straining out, capturing, and/or eliminating undesired solid and/or viscous material from a fluid.
finish—to bring to a desired and/or required state.
fire—to bake in a kiln and/or dry by heating.
first—an initial entity in an ordering of entities and/or immediately preceding the second in an ordering.
flat—having a substantially planar major face and/or having a relatively broad surface in relation to thickness or depth.
flatten—to make flat.
foil—a very thin, often flexible sheet and/of leaf, typically formed of metal.
form—(v) to construct, build, make, shape, produce, generate, and/or create; (n) a phase, structure, and/or appearance, and/or a first structure used to impart a spatial geometry on a second structure that is cast within and/or around the first structure.
formations—concave and/or convex elements on a surface; dimples, prongs, and/or protrusions.
formed—constructed.
from—used to indicate a source.
further—in addition.
gap—an interruption of continuity and/or a space between objects.
generate—to create, produce, render, give rise to, and/or bring into existence.
geometry—a three-dimensional arrangement, configuration, and/or shape.
halfway—midway between; at and/or near the middle and/or midpoint.
handling—of and/or relating to manual (and/or mechanical) carrying, moving, delivering, and/or working with something.
has—possesses, comprises, and/or is characterized by.
have—to possess and/or contain as a constituent part, and/or to possess as a characteristic, quality, and/or function.
having—possessing, characterized by, comprising, and/or including but not limited to.
heating—transferring energy from one substance to another resulting in an increase in temperature of one substance.
hole—an aperture, opening, perforation, pore, tunnel, chamber, cavity, pit, cranny, depression, and/or hollowed place in an object.
hole wall—a surface of material that defines and/or at least partially encloses a hole.
impart—to transmit, impose, convey, provide, and/or contribute
including—having, but not limited to, what follows.
incorporating—causing to comprise.
increase—to become greater or more in size, quantity, number, degree, value, intensity, and/or power, etc.
ingredient—an element and/or component in a mixture, compound, and/or composition.
initialize—to prepare something for use and/or some future event.
inner—closer than another to the center and/or middle.
insert—to put or introduce into.
install—to connect or set in position and prepare for use.
integral—formed or united into another entity.
inter-connecting—joined and/or fastened together reciprocally and/or with each other.
interact—to act on each other.
interconnected—connected internally.
interface—(n) a boundary across which two independent systems meet and act on and/or communicate with each other. (v) to connect with and/or interact with by way of an interface.
interlock—(v) to fit, connect, unite, lock, and/or join together and/or closely in a non-destructively and/or destructively releasable manner; (n) a device for non-destructively and/or destructively releasably preventing substantial relative motion between two elements of a structure.
intersection—a point and/or line segment defined by the meeting of two or more items.
into—to a condition, state, or form of and/or toward, in the direction of, and/or to the inside of.
invert—to reverse the position, order, condition, nature, and/or effect of
invertedly—in an reversed and/or opposing position, order, condition, nature, and/or effect.
investment casting—a forming technique and/or process that offers repeatable production of net shape components, typically with minutely precise details, from a variety of initially molten metals and/or high-performance alloys.
investment material—a material from which investment castings are formed.
inwardly—toward, internally, within, and/or not outwardly.
is—to exist in actuality.
laminate—to construct from layers of material bonded together.
lamination—a bonded, adhered, and/or attached structure and/or arrangement, typically formed of thin sheets; and/or a laminated structure and/or arrangement.

layer—a single thickness of a material covering a surface or forming an overlying part or segment; a ply, strata, and/or sheet.

layer-less—not formed of, and/or lacking a collection and/or stack of, plies, strata, and/or sheets.

length—a longest dimension of something and/or the measurement of the extent of something along its greatest dimension.

less than—having a measurably smaller magnitude and/or degree as compared to something else.

ligament—a connecting member such as a wall, beam, and/or rib.

liner—a sleeve, coating, and/or overlay.

link—(n) a chemical bond, such as a covalent bond; (v) to bond chemically, such as via covalent bond.

locate—to place, position, and/or situate in a particular spot, region, and/or position.

location—a place where, and/or substantially approximating where, something physically exists.

longitudinal—of and/or relating to a length; placed and/or running lengthwise.

longitudinal axis—a straight line defined parallel to an object's length and passing through a centroid of the object.

machining—the process of cutting, shaping, and/or finishing by machine, including, e.g., milling, cutting, turning, boring, drilling, abrading, broaching, filing, sawing, punching, blanking, and/or planing major—relatively great in size or extent.

make—to create, generate, build, and/or construct.

manner—a mode of action.

marking—a discernable symbol and/or an act of denoting by a discernable symbol.

mate—to join closely and/or pair.

material—a substance and/or composition.

may—is allowed and/or permitted to, in at least some embodiments.

measured—determined, as a dimension, quantification, and/or capacity, etc. by observation.

metal—any of a category of electropositive elements that usually have a shiny surface, are generally good conductors of heat and electricity, and can be melted or fused, hammered into thin sheets, or drawn into wires; an element yielding positively charged ions in aqueous solutions of its salts; a free metallic element (e.g., lithium), an alloy of two or more metals (e.g., 25% Na 75% K), an intermetallic compound (e.g., AlNi), and/or a mere mixture of particles of two or more metals; and/or, as found in the periodic table of the elements, any element not named in the following listing, all group VIII, VIIB, and VIB elements except polonium, nitrogen, phosphorus, carbon, silicon, and boron.

metallic—relating to, comprising, consisting essentially of, and/or composed substantially of one or more metals.

method—one or more acts that are performed upon subject matter to be transformed to a different state or thing and/or are tied to a particular apparatus, said one or more acts not a fundamental principal and not pre-empting all uses of a fundamental principal.

micro-features—irregularities, such as ridges and/or valleys, forming a roughness average on a surface of between approximately 1 microns and approximately 500 microns.

midpoint—a point of a line segment and/or or curvilinear arc that divides it into two parts of substantially the same length; and/or a position midway between two extremes.

misaligned—to place out of alignment and/or to offset.

mix—to create and/or form by combining and/or blending ingredients.

moat-like—resembling and/or having the physical properties of a ditch and/or channel surrounding an object.

model—a mathematical and/or schematic description of an entity and/or system.

mold—(n) a substantially hollow form, cavity, and/or matrix into and/or on which a molten, liquid, and/or plastic composition is placed and from which that composition takes form in a reverse image from that of the mold; (v) to shape and/or form in and/or on a mold.

molecule—the smallest particle of a substance that retains the chemical and physical properties of the substance and is composed of two or more atoms; and/or a group of like or different atoms held together by chemical forces.

molten—melted and/or made liquid by heat.

monolithic—constituting and/or acting as a single, substantially uniform and/or unbroken, whole.

more—a quantifier meaning greater in size, amount, extent, and/or degree.

node—a junctions and/or intersection of a plurality of non-co-linear ligaments.

non—not.

not—a negation of something.

nozzle—a burner structured and/or utilized such that combustible gas issues therefrom to form a steady flame; a short tube, usually tapering, forming the vent of a pipe-like structure; and/or a component that produces thrust by converting the thermal energy of hot chamber gases into kinetic energy and directing that energy along the nozzle's longitudinal axis.

offsetably—characterized by a misalignment, jog, and/or short displacement in an otherwise parallel and/or straight orientation and/or arrangement.

one—being or amounting to a single unit, individual, and/or entire thing, item, and/or object.

open—to release from a closed and/or fastened position, to remove obstructions from, and/or to clear.

or—used to indicate alternatives, typically appearing only before the last item in a group of alternative items.

orient—to position a first object relative to a second object.

orthogonal—perpendicular.

outer—farther than another from the center and/or middle.

outwardly—toward an outer surface and/or circumference of overlappingly—characterized by extending over and covering a part of something else.

pair—a quantity of two of something.

parallel—of, relating to, or designating lines, curves, planes, and/or or surfaces everywhere equidistant and/or an arrangement of components in an electrical circuit that splits an electrical current into two or more paths.

parent—an entity from which another is descended; and/or a source, origin, and/or cause.

part—component.

particle—a small piece or part. A particle can be and/or be comprised by a powder, bead, crumb, crystal, dust, grain, grit, meal, pounce, pulverulence, and/or seed, etc.

passage—a path, tunnel, hole, channel, and/or duct through, over, and/or along which something may pass.

pattern—a replica of an object to be cast and/or around which a mold is constructed.

percent—one part in one hundred.

perceptible—capable of being perceived by the human senses.

periodic—at regular and/or generally predictable intervals.

periphery—the outer limits, surface, and/or boundary of a surface, area, and/or object.

perpendicular—intersecting at and/or forming substantially right angles.

photolithography—a process whereby metallic foils, fluidic circuits, and/or printed circuits can be created by exposing a photosensitive substrate to a pattern, such as a predesigned structural pattern and/or a circuit pattern, and chemically etching away either the exposed or unexposed portion of the substrate.

physical—tangible, real, and/or actual.

physically—existing, happening, occurring, acting, and/or operating in a manner that is tangible, real, and/or actual.

place—to put in a particular place and/or position.

planar—shaped as a substantially flat two-dimensional surface.

plane—a substantially flat surface and/or a surface containing all the straight lines that connect any two points on it.

plurality—the state of being plural and/or more than one.

pocket—a receptacle and/or cavity.

portion—a part, component, section, percentage, ratio, and/or quantity that is less than a larger whole. Can be visually, physically, and/or virtually distinguishable and/or non-distinguishable.

position—(n) a place and/or location, often relative to a reference point. (v) to place, orient, arrange, and/or locate.

potential—having possibility.

predetermined—established in advance.

predominantly—mostly.

present—to introduce, provide, show, display and/or offer for consideration.

primary—first in an ordering.

prior—before probability—a quantitative representation of a likelihood of an occurrence.

process—(n.) an organized series of actions, changes, and/or functions adapted to bring about a result; (v.) to perform mathematical and/or logical operations according to programmed instructions in order to obtain desired information and/or to perform actions, changes, and/or functions adapted to bring about a result.

product—something produced by human or mechanical effort or by a natural process.

project—to calculate, estimate, or predict.

projection—a protrusion and/or a thing and/or part that extends outward beyond a prevailing line and/or surface.

prong—a projecting part, such as a protrusion, bar, stub, rod, pin, cylinder, etc.

protrude—to bulge, jut, project, and/or extend in an indicated direction, outward, and/or into space.

protrusion—that which protrudes.

provide—to furnish, supply, give, convey, send, and/or make available.

pull—to remove from a fixed position, to extract, and/or to apply force to so as to cause and/or tend to cause motion toward the source of the force.

pull-plane—a plane along and/or perpendicular to which a cast device is adapted to be urged to withdraw the cast device from a mold without substantial damage to the cast device and/or mold.

radius—the length of a line segment between the center and circumference of a circle or sphere.

range—a measure of an extent of a set of values and/or an amount and/or extent of variation and/or a defined interval characterized by a predetermined maximum value and/or a predetermined minimum value. Any range includes its endpoints unless stated otherwise.

receive—to get as a signal, take, acquire, and/or obtain.

reduce—to make and/or become lesser and/or smaller.

reduction—a diminishment in magnitude.

region—an area and/or zone.

remove—to eliminate, remove, and/or delete, and/or to move from a place or position occupied.

repeatedly—again and again; repetitively.

replace—to provide a substitute and/or equivalent in the place of.

replicate—to copy, duplicate, depict, mirror, reflect, resemble, reproduce, and/or repeat something and/or to make a substantially identical and/or spatially inverted copy, duplicate, reproduction, and/or repetition of something.

request—to express a desire for and/or ask for.

resin—any of numerous physically similar polymerized synthetics and/or chemically modified natural resins including thermoplastic materials such as polyvinyl, polystyrene, and polyethylene, and thermosetting materials such as polyesters, epoxies, and silicones that are used with fillers, stabilizers, pigments, and/or other components to form plastics.

roughness—not smooth, and/or having a surface marked by unevenness, irregularities, protuberances, and/or ridges, and/or the texture thereof, and/or a measurement of the texture thereof round—circular.

rubber—an elastomeric material such as, for example, natural rubber, nitrile rubber, silicone rubber, acrylic rubber, neoprene, butyl rubber, flurosilicone, TFE, SBR, and/or styrene butadiene rubber, etc.

said—when used in a system or device claim, an article indicating a subsequent claim term that has been previously introduced.

same—being the very one, identical, and/or similar in kind, quality, quantity, or degree.

scale—(n) a progressive classification, such as of size, amount, importance, and/or rank; (v) to increase or reduce proportionately in size.

seamlessly—existing, happening, occurring, acting, and/or operating in a manner that has no seams and/or is smoothly continuous and/or uniform in quality.

second—immediately following the first in an ordering.

secondary—second in an ordering.

select—to make a choice or selection from alternatives.

separate—(n) distinct; (v) to disunite, space, set, or keep apart and/or to be positioned intermediate to.

separated—not touching and/or spaced apart by something.

set—a related plurality of predetermined elements; and/or one or more distinct items and/or entities having a specific common property or properties.

shape—(v) to apply a characteristic surface, outline, and/or contour to an entity; (n) a characteristic surface, outline, and/or contour of an entity.

shear—a deformation resulting from stresses that cause contiguous parts of a body to slide relatively to each other in a direction parallel to their plane of contact; a deformation of an object in which parallel planes remain parallel but are shifted in a direction parallel to themselves; "the shear changed the quadrilateral into a parallelogram".

sheet—a broad, relatively thin, surface, layer, and/or covering shell—an external, usually hard, protective and/or enclosing case and/or cover.

shrinkage—the process of shrinking and/or the amount or proportion by which something shrinks sidewall—a wall that forms a side of something.

silica—silicon dioxide ($SiO_2$), which is a hard, glossy, white, and/or colorless crystalline compound and/or mineral, which occurs naturally and/or abundantly as quartz, quartz, sand, flint, agate, and many other minerals, and used to manufacture a wide variety of materials, especially glass and concrete.

silicone—any of a class and/or group of chemical compounds and/or semi-inorganic polymers based on the structural unit $R_2SiO$, where R is an organic group and/or radical, such as a methyl ($CH_3$) group and/or a phenyl ($C_6H_5$) group, typically characterized by wide-range thermal stability, high lubricity, extreme water repellence, and/or physiological inertness, often used in adhesives, lubricants, protective coatings, paints, electrical insulation, synthetic rubber, and/or prosthetic replacements for body parts.

siloxane—any of a class of organic and/or inorganic chemical compounds of silicon, oxygen, and usually carbon and hydrogen, based on the structural unit $R_2SiO$, where R is an alkyl group, usually methyl.

simulated—created as a representation or model of another thing.

single—existing alone or consisting of one entity.

sinter—to cause (e.g., a ceramic and/or metallic powder) to form a coherent mass by heating without melting.

slice—(n) a thin broad piece cut from a larger three dimensional object; (v) to cut and/or divide a three dimensional object into slices.

solid—neither liquid nor gaseous, but instead of definite shape and/or form.

solidification—the process of becoming hard and/or solid by cooling, drying, and/or crystallization.

solvent—a substance in which another substance is dissolved, forming a solution; and/or a substance, usually a liquid, capable of dissolving another substance.

space—an area and/or volume.

spatial—relating to an area or volume.

spatially—existing or occurring in space.

split—to break, divide, and/or separate into separate pieces.

stack—(n) a substantially orderly pile and/or group, especially one arranged in and/or defined by layers; (v) to place and/or arrange in a stack.

state—a qualitative and/or quantitative description of condition.

store—to place, hold, and/or retain data, typically in a memory.

strength—a measure of the ability of a material to support a load; the maximum nominal stress a material can sustain; and/or a level of stress at which there is a significant change in the state of the material, e.g., yielding and/or rupture.

stress—an applied force or system of forces that tends to strain or deform a body and/or the internal resistance of that body to such an applied force or system of forces.

structure—the way in which parts are arranged and/or put together to form a whole; the interrelation or arrangement of parts in a complex entity; a makeup of a device, portion of a device, that which is complexly constructed; and/or a manner in which components are organized and/or form a whole.

sub-plurality—a subset.

substantially—to a considerable, large, and/or great, but not necessarily whole and/or entire, extent and/or degree.

sufficiently—to a degree necessary to achieve a predetermined result.

support—to bear the weight of, especially from below.

surface—a face, material layer, and/or outer boundary of a body, object, and/or thing.

surface area—an extent of a 2-dimensional surface.

surround—to encircle, enclose, and/or confine on several and/or all sides.

system—a collection of mechanisms, devices, machines, articles of manufacture, processes, data, and/or instructions, the collection designed to perform one or more specific functions.

tactile—perceptible to the sense of touch; able to be felt via the fingertip.

target—a destination.

technique—a method.

tensile—pertaining to forces on a body that tend to stretch, or elongate, the body. A rope or wire under load is subject to tensile forces.

terminate—to end.

that—a pronoun used to indicate a thing as indicated, mentioned before, present, and/or well known.

thermal—pertaining to temperature.

thermoform—to shape (especially plastic) by the use of heat and pressure.

thickness—the measure of the smallest dimension of a solid figure.

through—across, among, between, and/or in one side and out the opposite and/or another side of through-hole—a hole that extends completely through a substrate.

time—a measurement of a point in a non-spatial continuum in which events occur in apparently irreversible succession from the past through the present to the future.

to—a preposition adapted for use for expressing purpose.

tool—something used to accomplish a task.

toward—used to indicate a destination and/or in a physical and/or logical direction of traditional—established, conventional, standard, orthodox, and/or customary, etc.

transform—to change in measurable: form, appearance, nature, and/or character.

transition—(v.) to pass, change, convert, and/or transform from one form, state, style, subject, and/or place to another; (n) a passage from one form, state, style, subject, and/or place to another.

triangular—pertaining to or having the form of a triangle; three-cornered.

turbomachine—a device in which energy is transferred to and/or from a continuously flowing fluid by dynamic interaction of the fluid with one or more moving and/or rotating blade rows, such as a turbine (e.g., windmill, water wheel, hydroelectric turbine, automotive engine turbocharger, and/or gas turbine, etc.) and/or an impeller (e.g., liquid pump, fan, blower, and/or compressor, etc.).

undercut—a notch, groove, and/or cut beneath.

upon—on occasion of, at which time, during, when, while, and/or immediately or very soon after.

vacuum—a pressure that is significantly lower than atmospheric pressure and/or approaching 0 psia.

vane—any of several usually relatively thin, rigid, flat, and/or sometimes curved surfaces radially mounted along an axis, as a blade in a turbine or a sail on a windmill, that is turned by and/or used to turn a fluid.

variance—a measure of variation of a set of observations defined by a sum of the squares of deviations from a mean, divided by a number of degrees of freedom in the set of observations.

vary—to deviate from a standard and/or expectation, and/or to make and/or cause changes in, and/or to modify and/or alter, and/or to have a range of different qualities and/or amounts, and/or to change over time, length, area, and/or space.

vent—to release from confinement.

version—a particular form or variation of an earlier and/or original type.

via—by way of and/or utilizing.

vibrate—to move back and forth or to and fro, especially rhythmically and/or rapidly.

visual—able to be seen by the eye; visible.

volume—a mass and/or a three-dimensional region that an object and/or substance occupies.

wall—a partition, structure, and/or mass that serves to enclose, divide, separate, segregate, define, and/or protect a volume and/or to support a floor, ceiling, and/or another wall.

wax—such as, for example, injection wax, and/or plastic injection wax, etc weakness—the state or quality of being weak, and/or lack of strength, firmness, and/or vigor, and/or an inadequate and/or defective quality, and/or a slight fault and/or defect.

weight—a force with which a body is attracted to Earth or another celestial body, equal to the product of the object's mass and the acceleration of gravity; and/or a factor and/or value assigned to a number in a computation, such as in determining an average, to make the number's effect on the computation reflect its importance, significance, preference, impact, etc.

where—at, in, to, and/or from what place, source, cause, situation, end, and/or position.

wherein—in regard to which; and; and/or in addition to.

while—for as long as, during the time that, and/or at the same time that.

width—the extent of something from side to side and/or orthogonal to length.

with respect to—in relation to, compared to, and/or relative to.

within—inside the limits of.

yet—not thus far.

zircon—a hard, brown to colorless mineral consisting of zirconium silicate ($ZrSiO4$).

zone—a portion of an isogrid containing an array of substantially identically-dimensioned triangular spaces. Within such an array, certain physical properties of the isogrid and/or its ligaments (such as compressive strength, shear strength, elasticity, density, opacity, and/or thermal conductivity, etc.) can be substantially isotropic, that is, substantially equal in all directions.

NOTE

Various substantially and specifically practical and useful exemplary embodiments of the claimed subject matter are described herein, textually and/or graphically, including the best mode, if any, known to the inventor(s), for implementing the claimed subject matter by persons having ordinary skill in the art. Any of numerous possible variations (e.g., modifications, augmentations, embellishments, refinements, and/or enhancements, etc.), details (e.g., species, aspects, nuances, and/or elaborations, etc.), and/or equivalents (e.g., substitutions, replacements, combinations, and/or alternatives, etc.) of one or more embodiments described herein might become apparent upon reading this document to a person having ordinary skill in the art, relying upon his/her expertise and/or knowledge of the entirety of the art and without exercising undue experimentation. The inventor(s) expects skilled artisans, after obtaining authorization from the inventor(s), to implement such variations, details, and/or equivalents as appropriate, and the inventor(s) therefore intends for the claimed subject matter to be practiced other than as specifically described herein. Accordingly, as permitted by law, the claimed subject matter includes and covers all variations, details, and equivalents of that claimed subject matter. Moreover, as permitted by law, every combination of the herein described characteristics, functions, activities, substances, and/or structural elements, and all possible variations, details, and equivalents thereof, is encompassed by the claimed subject matter unless otherwise clearly indicated herein, clearly and specifically disclaimed, or otherwise clearly inoperable or contradicted by context.

The use of any and all examples, or exemplary language (e.g., "such as") provided herein, is intended merely to better illuminate one or more embodiments and does not pose a limitation on the scope of any claimed subject matter unless otherwise stated. No language herein should be construed as indicating any non-claimed subject matter as essential to the practice of the claimed subject matter.

Thus, regardless of the content of any portion (e.g., title, field, background, summary, description, abstract, drawing figure, etc.) of this document, unless clearly specified to the contrary, such as via explicit definition, assertion, or argument, or clearly contradicted by context, with respect to any claim, whether of this document and/or any claim of any document claiming priority hereto, and whether originally presented or otherwise:

there is no requirement for the inclusion of any particular described characteristic, function, activity, substance, or structural element, for any particular sequence of activities, for any particular combination of substances, or for any particular interrelationship of elements;

no described characteristic, function, activity, substance, or structural element is "essential";

any two or more described substances can be mixed, combined, reacted, separated, and/or segregated;

any described characteristics, functions, activities, substances, and/or structural elements can be integrated, segregated, and/or duplicated;

any described activity can be performed manually, semi-automatically, and/or automatically;

any described activity can be repeated, any activity can be performed by multiple entities, and/or any activity can be performed in multiple jurisdictions; and any described characteristic, function, activity, substance, and/or structural element can be specifically excluded, the sequence of activities can vary, and/or the interrelationship of structural elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context.

The terms "comprising," "having," "including," and "containing" are to be construed as open-ended terms (i.e., meaning "including, but not limited to,") unless otherwise noted.

When any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate sub-range defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all sub-ranges therebetween, such as for example, 1 to 3.65, 2.8 to 8.14, 1.93 to 9, etc., even if those specific values or specific sub-ranges are not explicitly stated.

When any phrase (i.e., one or more words) appearing in a claim is followed by a drawing element number, that drawing element number is exemplary and non-limiting on claim scope.

No claim of this document is intended to invoke 35 USC 112 paragraph six (or paragraph f) unless the precise phrase "means for" is followed by a gerund.

Any information in any material (e.g., a United States patent, United States patent application, book, article, web page, etc.) that has been incorporated by reference herein, is incorporated by reference herein in its entirety to its fullest enabling extent permitted by law yet only to the extent that no conflict exists between such information and the other definitions, statements, and/or drawings set forth herein. In the event of such conflict, including a conflict that would render invalid any claim herein or seeking priority hereto, then any such conflicting information in such material is specifically not incorporated by reference herein. Any specific information in any portion of any material that has been incorporated by reference herein that identifies, criticizes, or compares to any prior art is not incorporated by reference herein.

Applicant intends that each claim presented herein and at any point during the prosecution of this application, and in any application that claims priority hereto, defines a distinct patentable invention and that the scope of that invention must change commensurately if and as the scope of that claim changes during its prosecution. Thus, within this document, and during prosecution of any patent application related hereto, any reference to any claimed subject matter is intended to reference the precise language of the then-pending claimed subject matter at that particular point in time only.

Accordingly, every portion (e.g., title, field, background, summary, description, abstract, drawing figure, etc.) of this document, other than the claims themselves and any provided definitions of the phrases used therein, is to be regarded as illustrative in nature, and not as restrictive. The scope of subject matter protected by any claim of any patent that issues based on this document is defined and limited only by the precise language of that claim (and all legal equivalents thereof) and any provided definition of any phrase used in that claim, as informed by the context of this document.

What is claimed is:

1. A method comprising:

investment casting an airfoil in a mold, the airfoil comprising at least one wall, the wall having a thickness within the range of 0.008 inches to 0.015 inches, the mold comprising a core, an inner primary shell, and an outer secondary shell, the core seamlessly combined with the inner primary shell and integral with the inner primary shell yet substantially separated from the inner primary shell by one or more core gaps, the inner primary seamlessly combined with the outer secondary shell and integral with the outer secondary shell yet substantially separated from the outer secondary shell by one or more shell gaps, wherein the one or more core gaps receive molten metal at substantially the same time as the one or more shell gaps.

2. The method of claim 1, wherein:

each of the one or more core gaps is defined by a length, a width that is perpendicular to the length, and a thickness that is perpendicular to the length and the width; and the thickness of each core gap varies in a predetermined manner along the length and/or width of that core gap.

3. The method of claim 1, wherein:

the inner primary shell is defined by a length, a width that is oriented orthogonal to the length, and a thickness that is oriented orthogonally to the length and the width; and the thickness varies in a predetermined manner along the length and/or width of the inner primary shell.

4. The method of claim 1, wherein:

each of the one or more shell gaps is defined by a length, a width that is perpendicular to the length, and a thickness that is perpendicular to the length and the width; and the thickness of each shell gap varies in a predetermined manner along the length and/or width of that shell gap.

5. The method of claim 1, wherein:

the outer secondary shell is defined by a length, a width that is oriented orthogonal to the length, and a thickness that is oriented orthogonally to the length and the width; and the thickness varies in a predetermined manner along the length and/or width of the outer secondary shell.

6. The method of claim 1, wherein:

the inner primary shell comprises a plurality of features that are configured to increase a strength of the inner primary shell in predetermined portions of the inner primary shell.

7. The method of claim 1, wherein:

the inner primary shell comprises a plurality of features that each have a predetermined shape and each located at a predetermined location.

8. The method of claim 1, wherein:

the inner primary shell comprises a plurality of surface features that are configured to increase a surface area of the inner primary shell.

9. The method of claim 1, wherein:

the inner primary shell comprises a plurality of surface features that are configured to increase a surface roughness at periodic locations on a surface of the inner primary shell.

10. The method of claim 1, wherein:

the inner primary shell comprises a plurality of surface features that each define an undercut in a surface of the inner primary shell.

11. The method of claim 1, wherein:

the inner primary shell comprises a handling connection configured for automated casting.

12. The method of claim 1, wherein:

the inner primary shell and/or outer secondary shell comprises an engineered weakness area configured for facilitating a breaking away of the inner primary shell for removal of the cast airfoil.

13. The method of claim 1, wherein:

the inner primary shell comprises a plurality of surface features that each have a depth within the range of 0.38 mm and 0.66 mm.

14. The method of claim 1, wherein:

the inner primary shell and core are formed from a different material than the outer secondary shell.

15. The method of claim 1, wherein:

the outer secondary shell is formed via a dipping process.

16. The method of claim 1, wherein:

the mold comprises a plurality of prongs that extend between and seamlessly connect the core and the inner primary shell, the plurality of prongs defining a corresponding plurality of film cooling holes in the airfoil, each of the plurality of prongs defines a fillet having a predetermined radius, the fillet located at an intersection of the prong and the inner primary shell or at an intersection of the prong and the core.

17. The method of claim 1, wherein:

the mold comprises a plurality of prongs that extend between and seamlessly connect the core and the inner primary shell, the plurality of prongs defining a corresponding plurality of film cooling holes in the airfoil, each of the plurality of holes defines a single passage that transitions to two or more passages.

* * * * *